US011111037B2

(12) United States Patent
Desertot

(10) Patent No.: US 11,111,037 B2
(45) Date of Patent: Sep. 7, 2021

(54) BLANK, METHOD OF MANUFACTURING A BELT, METHOD AND MACHINE FOR PACKAGING A PRODUCT IN A BOX

(71) Applicant: DS SMITH PLC, London (GB)

(72) Inventor: Didier Desertot, Arc sur Tille (FR)

(73) Assignee: DS Smith PLC, London (GB)

( * ) Notice: Subject to any disclaimer, the term of this patent is extended or adjusted under 35 U.S.C. 154(b) by 0 days.

(21) Appl. No.: 16/604,935

(22) PCT Filed: Apr. 12, 2018

(86) PCT No.: PCT/EP2018/059463
§ 371 (c)(1),
(2) Date: Oct. 11, 2019

(87) PCT Pub. No.: WO2018/189336
PCT Pub. Date: Oct. 18, 2018

(65) Prior Publication Data

US 2020/0255170 A1 Aug. 13, 2020

(30) Foreign Application Priority Data

Apr. 13, 2017 (EP) ..... 17000648

(51) Int. Cl.
*B65B 5/02* (2006.01)
*B31B 50/36* (2017.01)
(Continued)

(52) U.S. Cl.
CPC ..... *B65B 5/024* (2013.01); *B31B 50/36* (2017.08); *B31B 2100/0022* (2017.08);
(Continued)

(58) Field of Classification Search
CPC ..... B65D 5/064; B65D 2571/00037; B65D 2571/0066; B65B 2210/04; B65B 7/20; B65B 35/205; B31B 50/14
(Continued)

(56) References Cited

U.S. PATENT DOCUMENTS 1,425,714 A 8/1922 Stokes
3,608,701 A * 9/1971 Dieter ..... B65B 59/001 198/802
(Continued)

FOREIGN PATENT DOCUMENTS

CN 204548709 8/2015
GB 1193085 A 5/1970
(Continued)

OTHER PUBLICATIONS

International Search Report and Written Opinion for PCT/EP2018/059463 dated Jul. 13, 2018.

*Primary Examiner* — Christopher R Demeree
(74) *Attorney, Agent, or Firm* — Thomas|Horstemeyer LLP

(57) ABSTRACT

The invention relates to a one piece blank of a corrugated cardboard sheet material designed for forming a belt intended to form a box having a length L, a width W and a height H, wherein this blank includes a main rectangular body (10) extending along a longitudinal direction and two protruding rectangular parts (11, 12) extending in a transverse direction and symmetrically with regard to the main body, so as to define two perpendicular branches, a first branch being defined by the main body and a second branch defined by the protruding parts, the main body (10) having a width (D1) larger than the length L and a length (D2) larger than at least twice the width W plus the height H (2W+2H) and each of the protruding parts having a length (d1) larger
(Continued)

than the height H or the width W and a width (d2) larger than the width W or the height H.

9 Claims, 19 Drawing Sheets

(51) Int. Cl.
*B31B 100/00* (2017.01)
*B31B 110/35* (2017.01)
*B65D 5/66* (2006.01)

(52) U.S. Cl.
CPC ..... *B31B 2110/35* (2017.08); *B65B 2210/04* (2013.01); *B65D 5/6664* (2013.01); *B65D 5/6685* (2013.01)

(58) Field of Classification Search
USPC ..... 229/103; 206/585, 597; 493/122, 324; 53/462, 579
See application file for complete search history.

(56) References Cited

U.S. PATENT DOCUMENTS

| | | | | |
|---|---|---|---|---|
| 4,738,083 | A * | 4/1988 | Kawai | B65B 35/205 53/209 |
| 5,388,389 | A | 2/1995 | Tisma | |
| 9,840,347 | B1 * | 12/2017 | Linnell | B65D 81/09 |
| 10,683,110 | B2 * | 6/2020 | Smith | B65B 29/00 |
| 10,766,651 | B2 * | 9/2020 | Pettersson | B65B 43/08 |
| 2013/0247519 | A1 | 9/2013 | Clark | |
| 2014/0129018 | A1 * | 5/2014 | Morgana | B65D 5/425 700/98 |

FOREIGN PATENT DOCUMENTS

| | | |
|---|---|---|
| JP | S5487913 | 6/1979 |
| NL | 6612720 | 3/1968 |
| WO | 2014119439 A1 | 8/2014 |

* cited by examiner

Fig.9
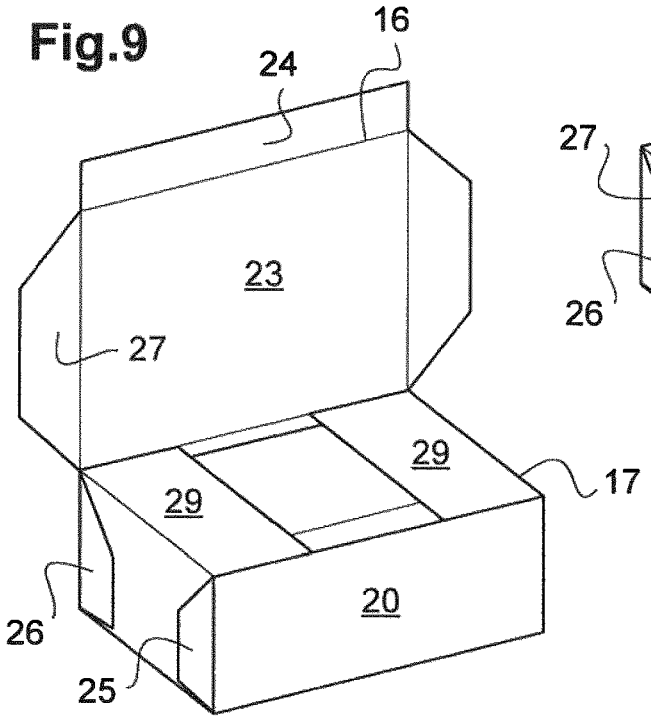
Fig.10
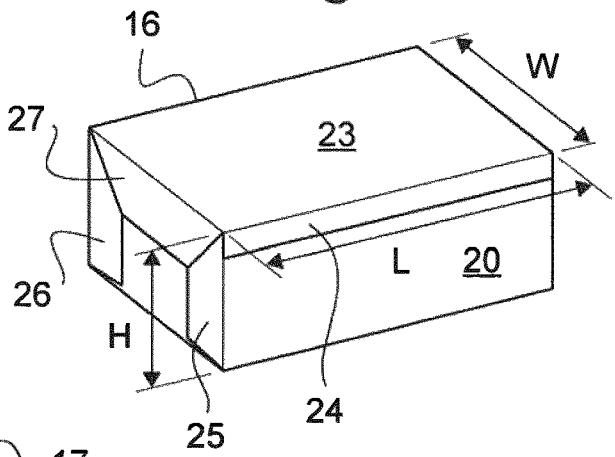
Fig.12
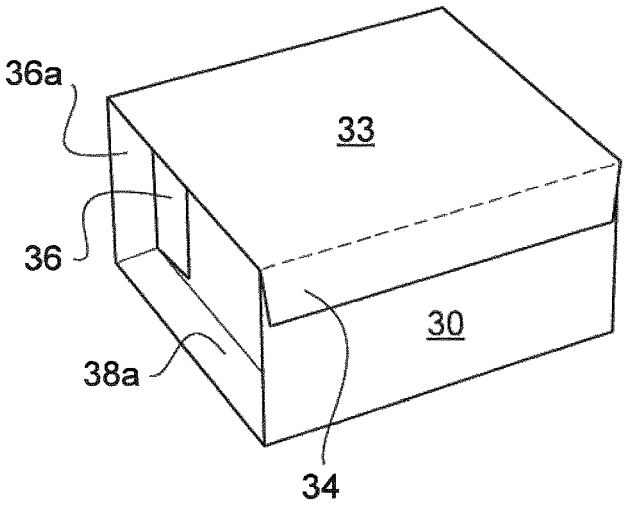
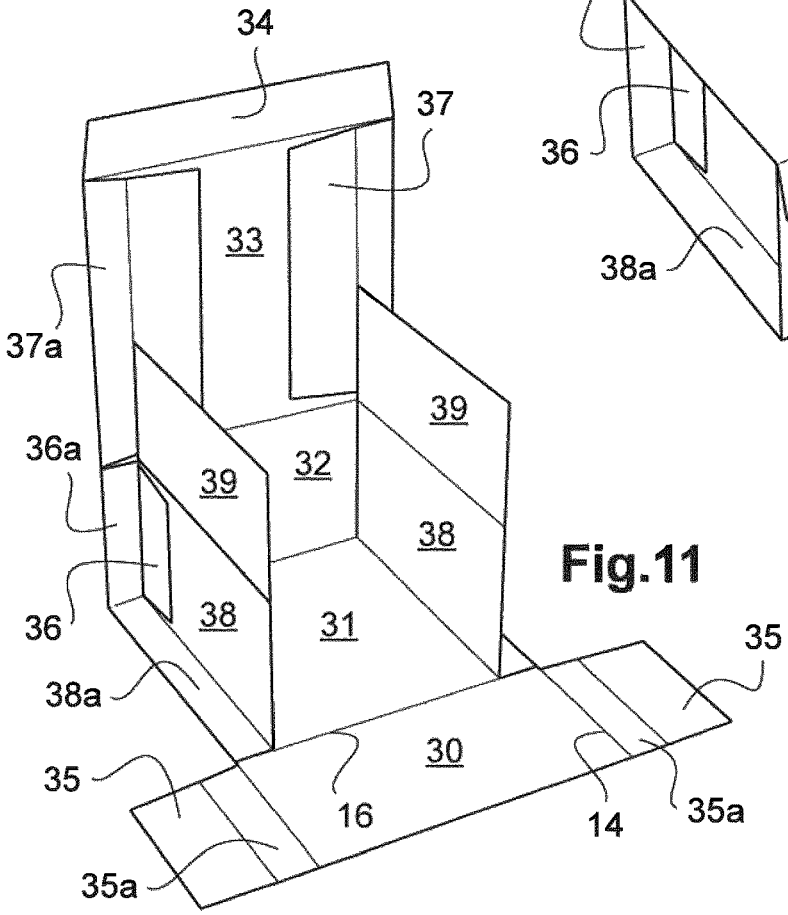
Fig.11

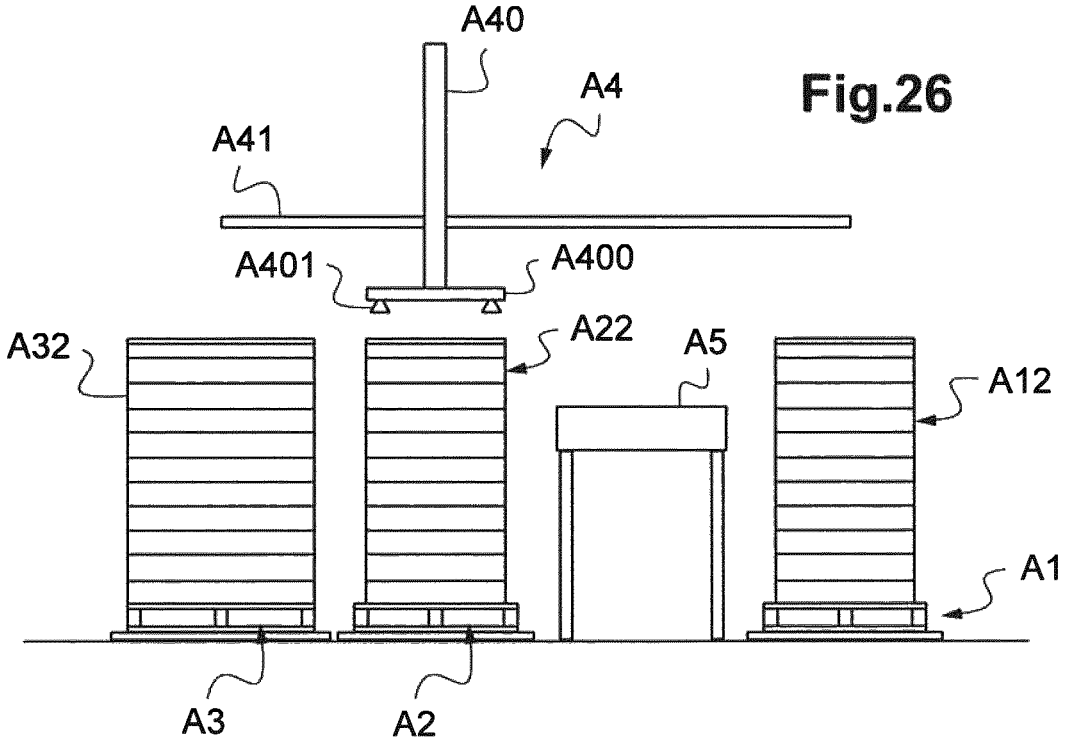
Fig.26
Fig.27
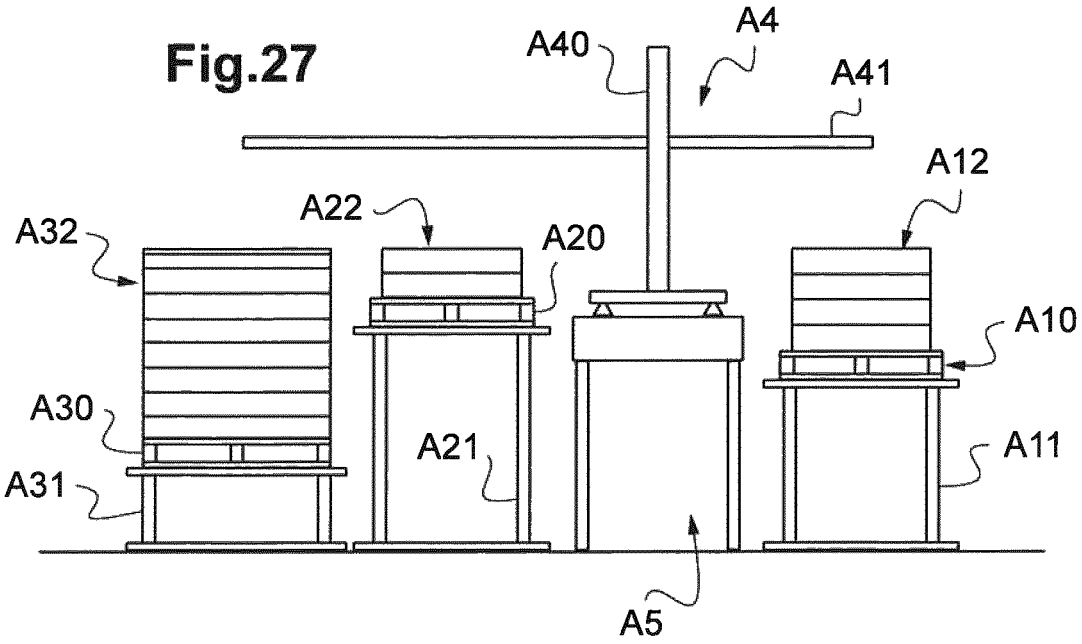

Fig.35A
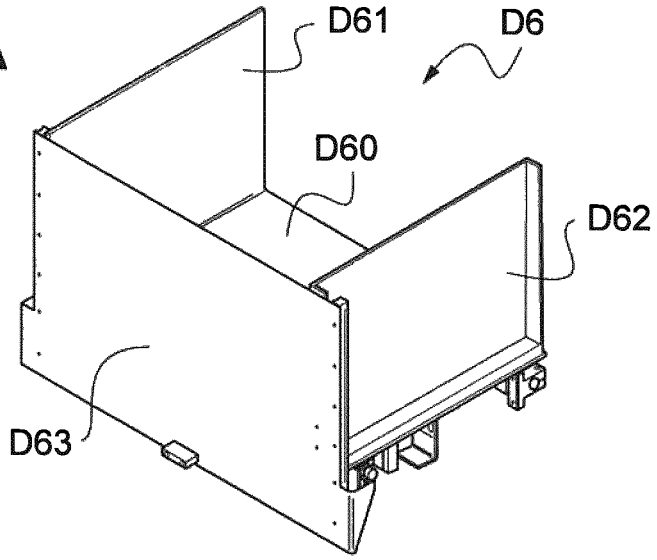
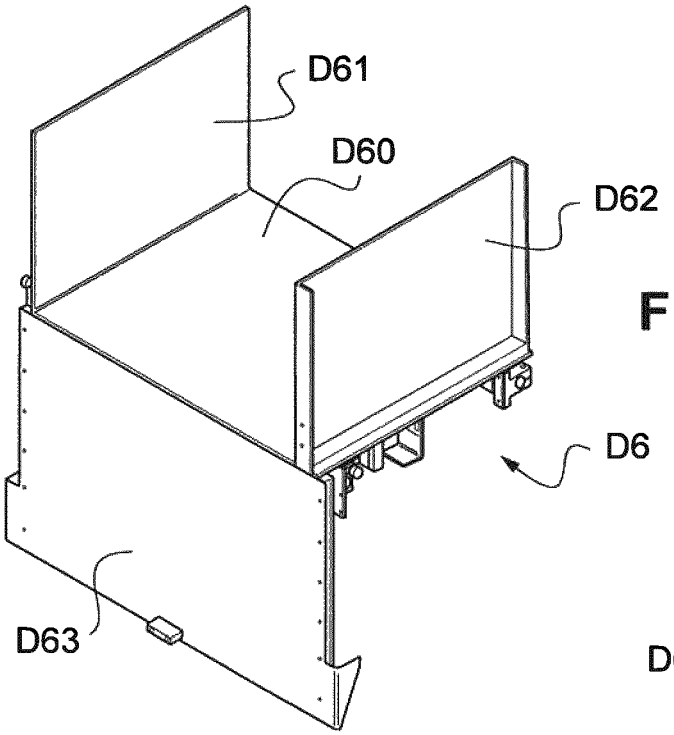
Fig.35B
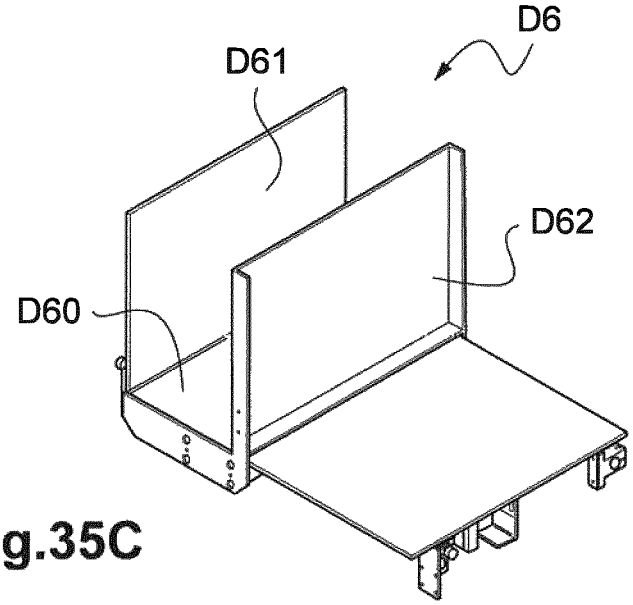
Fig.35C

BLANK, METHOD OF MANUFACTURING A BELT, METHOD AND MACHINE FOR PACKAGING A PRODUCT IN A BOX

CROSS-REFERENCE TO RELATED APPLICATIONS

This application is the 35 U.S.C. § 371 national stage application of PCT Application No. PCT/EP2018/059463, filed Apr. 12, 2018, where the PCT claims priority to, and the benefit of, EP application no. 17000648.0, filed Apr. 13, 2017, both of which are herein incorporated by reference in their entireties.

The present invention relates to a method and a machine for packaging products in a box of corrugated cardboard sheet material which is designed to have an inner space close to the size of the products which are intended to be housed in the box. This box is called a RSP box (Right Size Packaging box).

This box has a polygonal cross-section and is made of a single belt.

The invention also relates to a one piece blank and to a method of manufacturing a belt from a blank which allow such a box to be obtained.

A particularly important, though non-exclusive, use involves the field of boxes used for packaging online orders.

E-fulfillment companies face the problem of quickly packaging a high volume of products which can be all different in size.

One solution can be to have a limited number of alternative packagings, to select the one most adapted to the product to be packed and to use blocking and filling material to hold the product in place in the packaging.

It has also been proposed to measure the product with a 3D scanner in order to cut the carton to the right size, the carton being then folded around the product and the edges of the box glued in order to close the box.

With this solution, there is no need for padding material, since the carton is cut exactly to the right size.

It still have some drawbacks lacks since the final box cannot be reused after it has been opened, thus preventing a customer to use the box for sending back the product to the sender for exchange.

Reference is also made to WO 2014/119439 which relates to a device for preparing a corrugated cardboard box of a determined size by cutting a cardboard.

Only a single rectangular cardboard of predetermined length and width is available. It is cut to obtain a blank with dimensions corresponding to the box, thus generating a large amount of waste material.

Moreover, a packaging is currently used for several products and wrapping a carton around them is difficult without holding them together. Therefore, additional means such as a wrapping film are necessary and are detrimental to the costs of the packaging.

An object of the present invention is to provide a method and a machine for packaging a product or several products (hereafter called product(s)) in a box of corrugated cardboard sheet of material which has a polygonal cross-section and which better complies with the requirements of the e-fulfillment practice than previously known packages, in particular in that it allows the disadvantages of known packages to be overcome, by using less material and therefore reducing the waste of material, by avoiding the use of a wrapping film and/or of blocking and filling material and by providing a re-usable box, while allowing automatic packaging formation in an easy, automatic and efficient manner.

The method and the machine according to the invention are both based on the acquisition of size information concerning the product(s) to be packed, this size information being used to determine the length L, the width W and the height H of the box designed for the product(s), i.e. designed to have an inner space close to the size of the product(s) which are intended to be housed in the box.

In all the specification, the length L, the width W and the height H of a box are determined by the following condition: the length L is larger than the width W which is larger than the height H.

The method and the machine according to the invention involve the use of special blanks which are designed to be readily adapted to the size of the final box while reducing the amount of material needed to manufacture the final box and the waste of material, in particular during the manufacturing of the box.

The invention proposes a one piece blank of a corrugated cardboard sheet material designed for forming a belt intended to form a box having a length L, a width W and a height H. This blank includes a main rectangular body extending along a longitudinal direction and two protruding rectangular parts extending in a transverse direction and symmetrically with regard to the main body, so as to define two perpendicular branches, a first branch being defined by the main body and a second branch defined by the protruding parts, the main body having a width larger than the length L and a length larger than at least twice the width W plus the height H (2W+2H) and each of the protruding parts having a length larger than the height H or the width W and a width larger than the width W or the height H.

In advantageous embodiments, use is further and/or also made of one and/or other of the following arrangements:

- the blank is cross-shaped and each of the protruding parts has a length larger than the height H and a width larger than the width W, and is positioned relative to the main body so that it is spaced from each end of the main body by a distance larger than the height H or the width W plus the height H (W+H);
- the blank has a T-shape and each of the protruding parts has a length larger than the width W and a width larger than the height H;

the belt having four rectangular main panels intended to form the top, the bottom and the first and second lateral walls of the box and at least one pair of first flaps being connected on opposing sides of a main panel, the width of the main body is equal to or larger than the length L plus twice the width w' of a first flap of the box;

the belt having four rectangular main panels intended to form the top, the bottom and the first and second lateral walls of the box and the main panel of the belt intended to form the top of the box being connected to a third flap which is intended to be glued on the second lateral wall to close the box, the length of the main body is equal to or larger than twice the width W and the height H (2W+2H) plus the width w of the third flap of the box;

one of the main panels of the belt intended to form the bottom of the box being provided on each of two opposing sides with a secondary panel intended to form the third or the fourth lateral wall of the box and each of the secondary panels being connected to a flap, each of the protruding part has a length larger than the height H and the width w" of said flap.

The invention also relates to a method of manufacturing a belt from a blank of a corrugated cardboard sheet material according to the invention and provided in a stack of blanks, the belt being intended to form a box having a length L, a width W and a height H close to the size of the products to be housed in the box wherein, after removal of the blank from the stack, it is then cut to reduce the length and/or the width of the branches of the blank so that they are adapted to the dimensions of the belt. Two first parallel fold lines are created between the main body and the protruding parts to define the secondary panels which are intended to form the third or the fourth lateral wall of the box and determine the height H and the width W of the box and at least three second parallel fold lines are created in the main body to define four main rectangular panels which are intended to form the top, the bottom and the first and second lateral walls of the box and determine the length L and the width W and/or the height H of the box, first parallel fold lines being perpendicular to the second fold lines and a secondary panel being provided on each of two opposing sides of one of the main panels.

In advantageous embodiments, use is further and/or also made of one and/or other of the following arrangements:

the first fold lines extend on each side of the main panels, to define at least one pair of first flaps connected on opposing sides of a main panel;

a second first fold line is created in the main panel forming the top of the box to define a third flap connected to the main panel intended to form the top of the box; p the secondary panels being provided on each side of the main panel intended to form the bottom of the box, a third fold line parallel to the first fold lines is created in each of the secondary panel to define a flap;

intermediate fold lines, parallel to the first and third fold lines, are created in the flaps and in the protruding parts to define intermediate flaps or panels.

It also concerns a method for packaging at least one product in a box comprising the steps of:

measuring the size of the product(s)

determining the length L, the width W and the height H of the box closely adapted to the size of the product(s) to be packed in the box choosing a blank corresponding the length L, the width W and the height H of the box and according to the invention manufacturing a belt with the method according to the invention from said blank erecting a box with the method according to the invention placing the product(s) in the box and closing the box.

The products are preferably introduced laterally in the box.

Finally, the invention relates to a machine for packaging at least one product in a box comprising:

a unit D for preparing the product(s) and measuring their size means for determining the length L, the width W and the height H of the box closely adapted to the size of the products to be packed in the box means for determining a type of blank of corrugated cardboard material corresponding to the length L, the width W and the height H of the box and according to the invention a unit A including at least two stacks of blanks of different types (T1 to T3)

a unit B including a transformation line to transform the blank into a belt and box forming means a unit C for the filling the at least partially erected box F with the products for which it is designed and a Unit E for closing the box.

In advantageous embodiments, use is further and/or also made of one and/or other of the following arrangements:

in unit A, the at least two stacks are provided on vertically movable pallets;

the transformation line includes cutting means for reducing length and/or the width of the blank;

the transformation line includes means for creating fold lines in the blank;

unit D comprises crates for the transportation of the products, each of them including a bottom, two lateral sides, one of them being fixed and the other movable and a retractable backside, the unit C for filling the products being arranged to fill said products laterally.

The invention proposes a box of corrugated cardboard sheet material exhibiting a polygonal cross section and having a top, a bottom and four lateral walls, the first and second ones, respectively the third and fourth ones being opposite each other, wherein said box has a length L, a width W and a height H close to the size of the products to be housed in the box and comprises a belt having four rectangular main panels forming the top, the bottom and the first and second lateral walls of the box, with second parallel fold lines extending between two adjacent main panels, wherein one of the main panels is provided on each of two opposing sides with a secondary panel forming the third or the fourth lateral wall of the box, first parallel fold lines extending between the said main panel and the secondary panels which are perpendicular to the second fold lines.

In advantageous embodiments, use is further and/or also made of one and/or other of the following arrangements:

the belt comprises at least one pair of first flaps connected on opposing sides of a main panel, these first flaps being glued to the third and fourth lateral walls of the box;

the main panel forming the top of the box is connected to a third flap which is intended to be glued on the second lateral wall to close the box;

the secondary panels are provided on each side of the main panel forming the bottom of the box.

each of the secondary panel is connected to a flap by means of a third fold line parallel to the first fold lines, this flap being intended to be folded toward the interior of the box along said fold line;

two pairs of first flaps are provided on the opposing sides of the main panels forming the first and the second lateral walls of the box;

each first flap is provided with an intermediate flap defined between a first fold line and an intermediate fold line and each secondary panel is provided with an intermediate panel defined between a first fold line and an intermediate fold line, each intermediate flap or panel being folded toward the interior of the box and glued to the adjacent main panel;

the secondary panels are provided on the main panel forming the second lateral wall of the box.

two pairs of first flaps are provided on the opposing sides of the main panels forming the bottom and the first lateral wall of the box;

one pair of first flaps is provided on the opposing side of the main panel forming the first lateral wall of the box, these first flaps being provided with an intermediate flap defined between a first fold line and an intermediate fold line and wherein each secondary panel is provided with an intermediate panel defined between a first fold line and an intermediate fold line, each intermediate flap or panel being folded toward the interior of the box and glued to the adjacent main panel;

a pair of second flaps is provided on the opposing sides of the main panel forming the top of the box, these flaps being folded and glued on this panel or on the third and fourth walls of the box;

all the intermediate flaps and/or panels have the same width.

The invention also concerns an assembly of a box according to the invention and of products for which it is designed.

In other words, the invention also concerns an assembly of at least one product and a box according to the invention which is made of a belt and comprises a top, a bottom and four lateral walls, each of them having an outer face and an inner face, these six inner faces defining an inner space in which the at least one product is housed.

When the box is designed for only one product, the length L, the width W and the height H of the box are chosen so that the product is in tight contact with at least two different inner faces of the box to be held in place in the box, and preferably with each inner face of the box.

When the box is designed for housing at least two products, the products are assembled or stacked so that each product is in tight contact at least with another product and, when the products are housed in the box, each product is in tight contact with at least two among an inner face of the box and another product.

The contact between a product and another product or with an inner face of the box is along a side, a line, an edge, a surface or only a contact point.

In both cases, the box is therefore designed to avoid any movement of a product in the inner space defined by the box or any movement of a product with regard to another product housed in the box, and preferably, to limit the part of its inner space which is not filled with the product(s).

The invention also relates to a belt made of corrugated cardboard sheet material designed to form a box of polygonal cross section which has a top, a bottom and four lateral walls, the first and second ones, respectively the third and fourth ones being opposite each other, said box having a length L, a width W and a height H close to the size of the products to be housed in box and the belt having four rectangular main panels forming the top, the bottom and the first and second lateral walls of the box, with second parallel fold lines extending between two adjacent main panels, one of the main panels is provided on each of two opposing sides with a secondary panel forming the third or the fourth lateral wall of the box, first parallel fold lines extending between the said main panel and the secondary panels which are perpendicular to the second fold lines.

In advantageous embodiments, use is further and/or made of one and/or other of the following arrangements:

it comprises at least one pair of first flaps connected on opposing sides of two of the main panels;

the main panel forming the top of the box is connected to a third flap by means of a second fold line;

the secondary panels are provided on the main panel forming the bottom of the box;

each of the secondary panel is connected to a flap by means of a third fold line parallel to the first fold lines;

two pairs of first flaps are provided on the opposing sides of the main panels forming the first and the second lateral walls of the box.

each first flap is provided with an intermediate flap defined between a first fold line and an intermediate fold line and wherein each secondary panel is provided with an intermediate panel defined between a first fold line and an intermediate fold line;

the secondary panels are provided on the main panel forming the second lateral wall of the box.

two pairs of first flaps are provided on the opposing sides of the main panels forming the bottom and the first lateral wall of the box.

one pair of first flaps is provided on the opposing side of the main panel forming the first lateral wall of the box, these first flaps being provided with an intermediate flap defined between a first fold line and an intermediate fold line. Each secondary panel is provided with an intermediate panel defined between a first fold line and an intermediate fold line;

a pair of second flaps is provided on the opposing sides of the main panel forming the top of the box.

all the intermediate flaps and/or panels have the same width.

The invention relates to a method of forming a box having a top, a bottom and four lateral walls, the first and second ones, respectively the third and fourth ones being opposite each other, from a belt according to the invention wherein, after production of the belt, it is folded along the first, second (and third) fold lines and the box is then erected.

The invention will be better understood from a reading of the embodiments given below by way of non-limiting examples. It refers to the drawings which accompany it and in which:

FIGS. 8 to 10 are perspective views showing the packing of items in the box illustrated in FIG. 7.

FIGS. 11 and 12 are perspective views showing the erection of a box made from the blank illustrated in FIG. 6 and its closing.

FIG. 26 is a side view of unit A (Storage and feeding Unit).

FIG. 27 is a view similar to FIG. 26 showing unit A in a different configuration.

FIGS. 35A to 35C are perspective views illustrating the crate used in unit D.

FIG. 1 shows a one piece blank 1 according to a first embodiment of the invention, this blank 1 being cross-shaped and obtained from a sheet of corrugated cardboard material by rotary or flat-bed die cutting.

At this stage, it can be pointed out that the size and shape of the blank are adapted to the size of the final box in order to reduce waste material.

Moreover, a large amount of the cardboard material which will not be used to manufacture the final box is already removed. This removal reduces waste material during the manufacture of the box.

This blank is a sharp-edge component which is supplied without any cut or fold line.

By implementing the method according to the invention, a belt 2 (illustrated in FIG. 5) can be obtained from this blank 1, this belt being used to form a box having a polygonal cross section.

Blank 1 has been chosen among a pre-determined number of different blanks having different dimensions, this choice depending on the size of the product(s) to be packed in a box according to the invention.

In order to make a choice between the different blanks which are available, the products are assembled to form the most compact assembly or stack and the stack is measured.

Measuring means including for instance a laser means are used to determine the largest length, width and height of the single item or of the assembled or stacked products.

In case a single item has to be packed, it is directly measured.

These measures enable to determine the length L, the width W and the height H of the box able to house the product (s) with the highest filling rate. (see FIGS. 10 and 21).

All dimensions given in this specification refer to internal dimensions of the box.

At this stage, it must be pointed out that the dimensions of the box can be freely chosen and that the available blanks are chosen to meet all the possible combinations of products intended to be packed and sent to a final client.

This blank 1 comprises a main rectangular body 10 extending in a longitudinal direction and two protruding rectangular parts 11, 12 extending in a transverse direction (perpendicular to the longitudinal direction).

Figure 1:
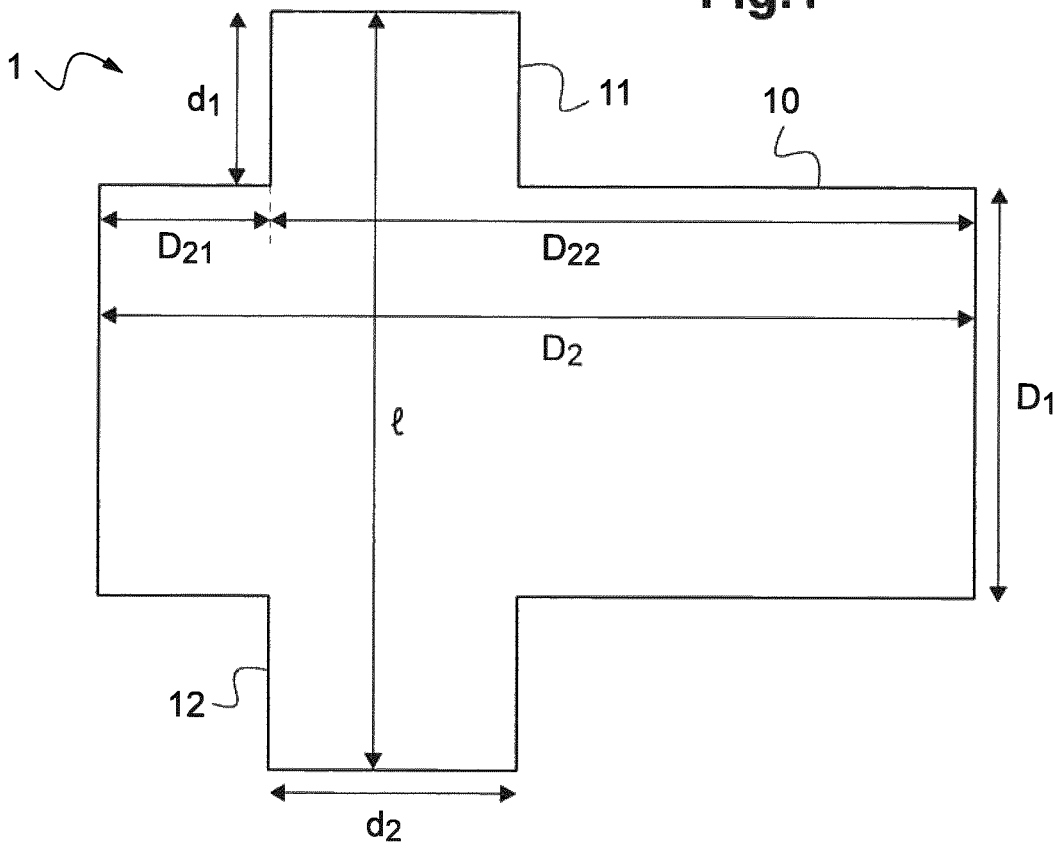
FIG. 1 is a top view of a one piece blank according to a first embodiment of the invention.

FIG. 1 shows that the protruding parts 11 and 12 are symmetrical with regard to the main body (or its longitudinal direction).

The blank 1 has more specifically the shape of a Latin cross with a first (long) branch formed by the main body 10 and a second (short) branch formed by the protruding parts 11, 12, the second branch being offset with regard to the center of the first branch.

The main body 10 has a first dimension D1 along its transverse direction (width of the first branch) which is larger than the length L of the box and a second dimension D2 along its longitudinal direction (length of the first branch) which is larger than twice the width W plus the height H of the box (2 W+2 H).

In the following description, the example of the box according to the invention includes different flaps (described later), so that the second dimension D2 is larger than 2 W+2 H+w, where w is the width of a third flap and D1 is larger than L+2 w', where w' is the width of each of first or second flaps.

Each of the protruding parts 11 and 12 has a first dimension (length) d1 along the transverse direction of the main body which is larger than the height H of the box and a second dimension d2 (width of the second branch) along the longitudinal direction of the main body which is larger than the width W of the box.

Therefore, the length l of the second branch of the cross is larger than the length L plus twice the height H of the box (L+2 H). The example of box described later includes other flaps (flaps 29 described later) so that the length l is defined to be larger than the length L of the box plus twice the height H of the box plus twice the width w" of said flaps (L+2 H+2 w").

Roughly speaking, the main body 10 has a second dimension D2 (length) large enough in view of the width W and the height H of the final box, while the length l of the short branch of the cross (l=D1+2d1) is large enough in view of the length L and the height H of the final box.

Concerning now the relative position of the first and second branches of the cross, the second dimension D2 can be divided in two: D21 corresponds to the shorter distance (in the longitudinal direction) between a free edge of the main body 10 and each protruding part and D22 corresponds to the difference between D2 and D21 (D22=D2−D21).

D21 is chosen so that it is larger than the height H of the box while D22 is larger than the height H plus twice the width W of the box plus the width w of the third flap.

It is thus understood that the choice of a blank 1 between the predetermined number of different available blanks is made so that the chosen blank has the dimensions closest to the ones of the final box in order to reduce the waste.

After extraction from a stack of blanks by means of suction pads, the blank 1 is transferred to a conveyor which is driven in order to have a linear motion through a transformation line.

In all the specification, a conveyor used to transfer a blank, a belt or a box can be a vacuum conveyor on any other means such as two conveyors, one placed on a top of the other, or a system including at least one arm with suction pads.

Figure 5:
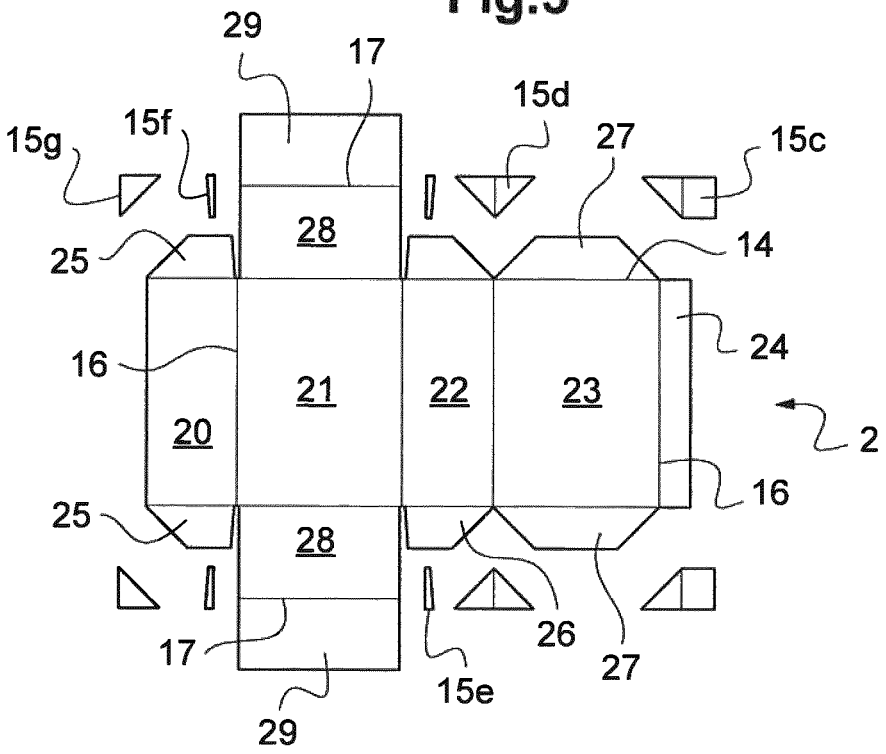

It will be now described how the blank 1 illustrated in FIG. 1 is processed in order to obtain a belt 2 as illustrated in FIG. 5.

Figure 2:
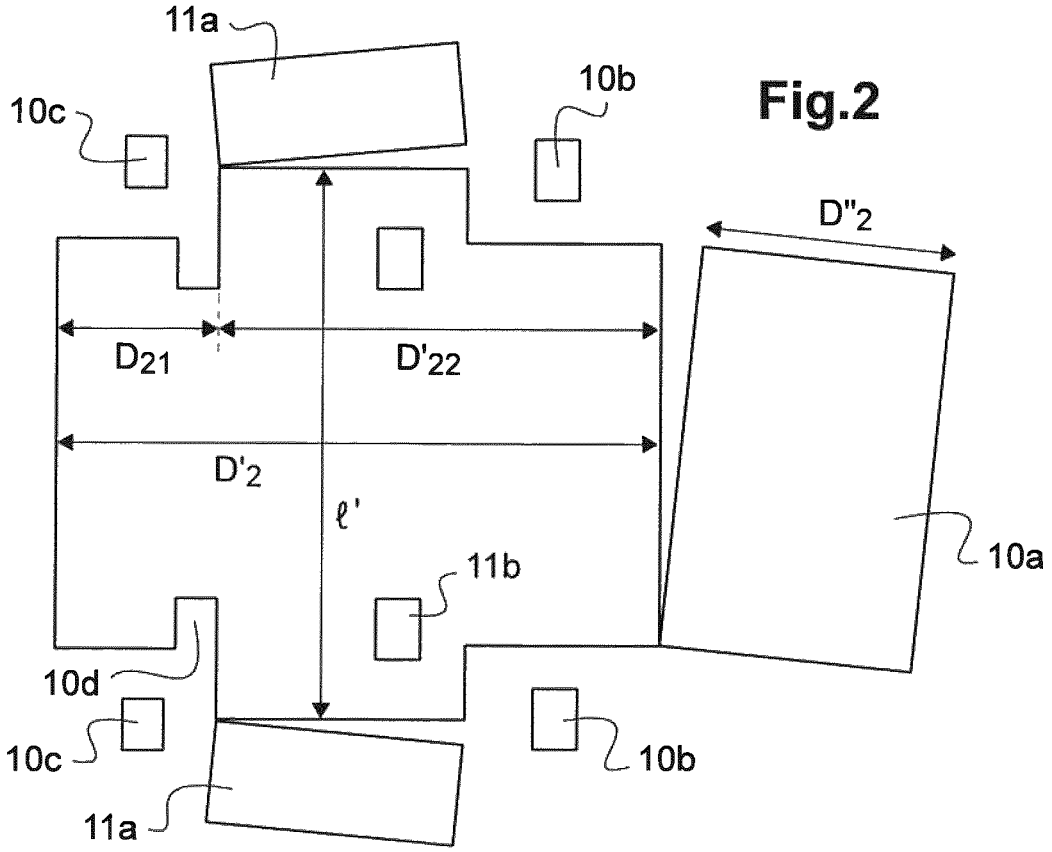
FIGS. 2 to 5 are top views of the blank of FIG. 1 illustrating steps of forming a belt from the blank.

FIG. 2 shows a first step during which the blank 1 is cut to reduce its second dimension D2 (the modified length of the first branch becoming D2') and more specifically D22, so that the distance D22' corresponding to the difference between D2' and D21 is now equal to the sum of twice the width W plus the height H of the box, plus the width w of the third flap (D22'=H+2 W+w).

In other words, this cut of the main body 10 reduces the length of the first (large) branch of the cross and creates waste 10*a* having a second dimension D2" which is equal to D2 minus the height H, twice the width W and the width w (D2"=D22−H−2 W−w).

Further cuts are made in the main body 10 to facilitate the following operations which create waste 10*c* and 10*d*. A hole lib is thus made in each protruding part and notches 11*d* are made in the main body 10. These cuts can be omitted.

During the linear transfer of the blank on the conveyor, the protruding parts 11 and 12 are cut to reduce their first dimension d1 so that the length l' of the short branch of the cross is equal to the sum of the length L of the final box plus twice its height H plus twice the width w" of the flaps 29 ( l'=L+2H+2 w"), which will be described later.

This cut creates identical waste.

Figure 3:
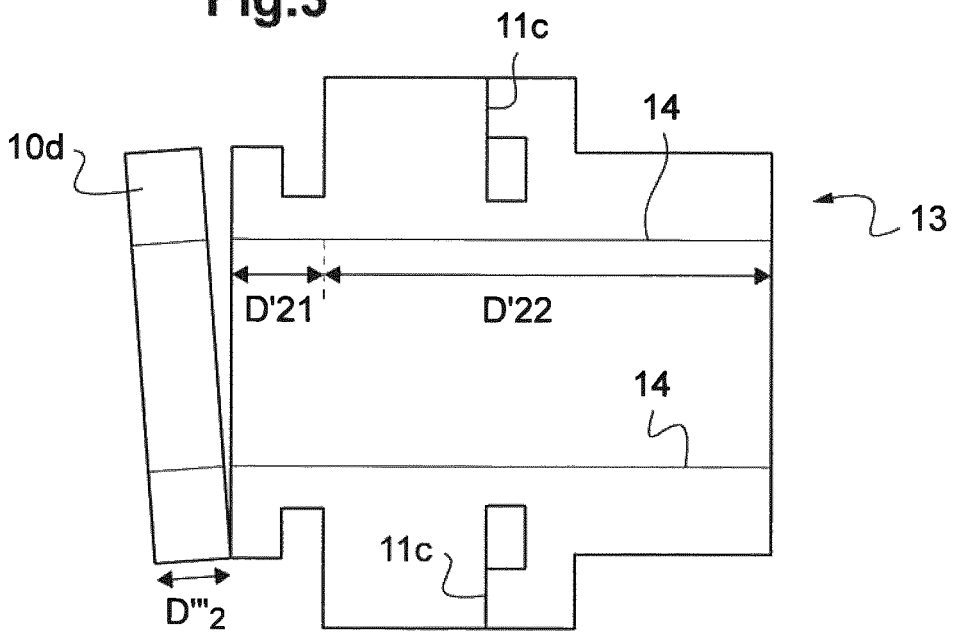

FIG. 3 illustrates a further step of the method during which the modified blank 13 is still moving linearly on the conveyor and its first (long) branch is cut again but on the side of the blank opposite the one already cut in the first step.

With this cut, the longitudinal dimension D21 is reduced and becomes D21' which corresponds to the height H of the final box.

This second cut creates a waste 10*d* having a second dimension D2"' which is equal to D21 minus the height H (D2"'=D21−H).

FIG. 3 shows that during the transfer of the modified blank, first fold lines 14 are created along the longitudinal direction of the modified blank (or along the long branch of the cross). As explained later, these first fold lines 14 will define the first and second flaps.

The distance between both first fold lines 14 is equal to the length L of the final box.

Cuts 11*c* are also made in the protruding parts between a free edge and each hole 11*b* to facilitate the following operations. They can therefore be omitted. They can be made with the holes 11*b* and the notches 11*d* or by two supplementary guillotine actions.

Figure 4:
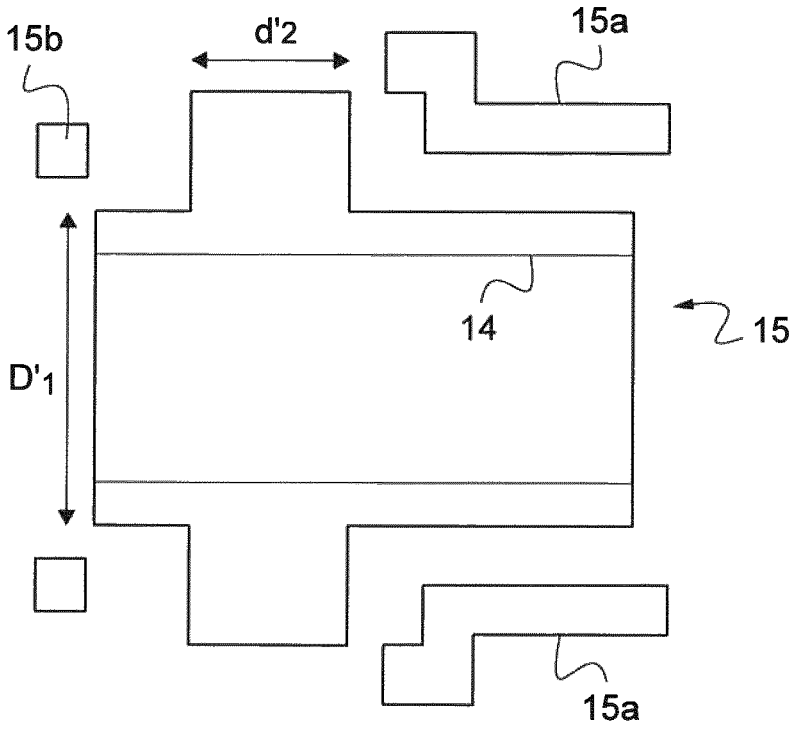

The modified blank 15 obtained at the end of this step is transferred by the conveyor and FIG. 4 illustrates the next step during which further cuts are made to adjust the first dimension D1 of the main body and the second dimension d2 of the protruding parts 11 and 12.

With these cuts, the first dimension of the main body (width of the first branch) is reduced to D1' which is equal to the length L of the box and twice the width w' of a first or second flap (D1'=L+2 w') while the second dimension d2' of each protruding part (width of the second branch) is now equal to the width W of the final box.

This cutting step creates waste identified by the references 15*a* and 15*b*.

FIG. 5 illustrates the last step of the method of forming a belt 2 from the blank 1 of FIG. 1, according to the invention.

As shown in FIG. 5, four second fold lines 16, perpendicular to the first fold lines 14, are created in the main body which define four main rectangular panels 20 to 23 and the third flap 24 having the width w.

The four main rectangular panels 20 to 23 have all the same length which is equal to the length L on the final box but they have different widths.

The width of the panels 20 and 22 (small panels) is equal to the height H of the box while the width of the panels 21 and 23 (large panels) is equal to the width W of the box.

Moreover, third fold lines 17 are created in the protruding parts, these third fold lines being parallel to the first fold lines 14.

Each of these third fold lines 17 is spaced apart from the adjacent first fold line 14 from a distance which is equal to the height H of the final box.

FIG. 5 also shows that the main body is cut on each of its longitudinal sides and in line with the second fold lines 16.

These cuts extend between the free longitudinal edge of the main body and the adjacent first fold line 14 and they create wastes 15*c* to 15*g*.

This cutting step defines two pairs of first flaps 25 and 26 connected on opposing sides of the small main panels 20 and 22 by means of a first fold line 14.

Moreover, a pair of second flaps 27 is provided on the opposing sides on the large main panel 23, these flaps 27 being connected to the main panel 23 by means of a first fold line 14.

The width of the first flaps 25, 26 and second flaps 27 is w'.

Moreover, the protruding parts form, on each side of the main large panel 21, a secondary panel 28, each of them being connected to a flap 29 by means of a third fold line 17, each flap 29 having a width w".

Figure 7:
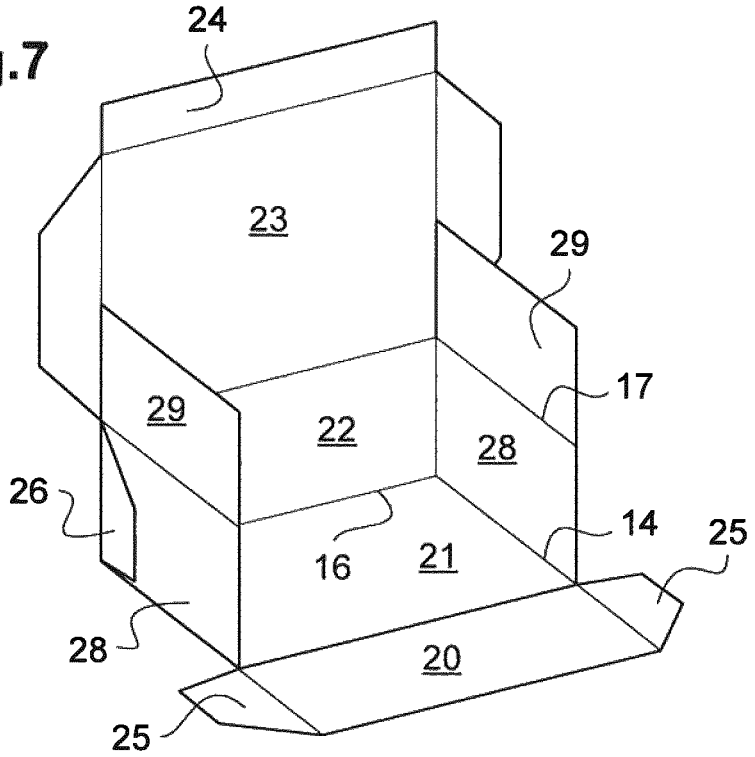
FIG. 7 is a perspective view of a box partially erected and made from the belt illustrated in FIG. 5.

After its formation, the belt 2 is transferred for glue coating and the box is partially erected as shown in FIG. 7.

To this end, each of the secondary panels 28 is folded along a first fold line 14 then, the small main panel 22 is folded along a second fold line 16 and finally, the first flaps 26 are glued on the outer face of the secondary panels 28.

FIG. 7 shows that the main large panel 21 will form the bottom of the box while the other large main panel 23 will form the top of the box.

Moreover, the small main panels 22 and 20 will form the first and second lateral walls of the box, while the secondary panels 68 form the third and fourth lateral walls of the box.

After having been partially erected as shown in FIG. 7, the box is transferred to the filling station.

Figure 8:
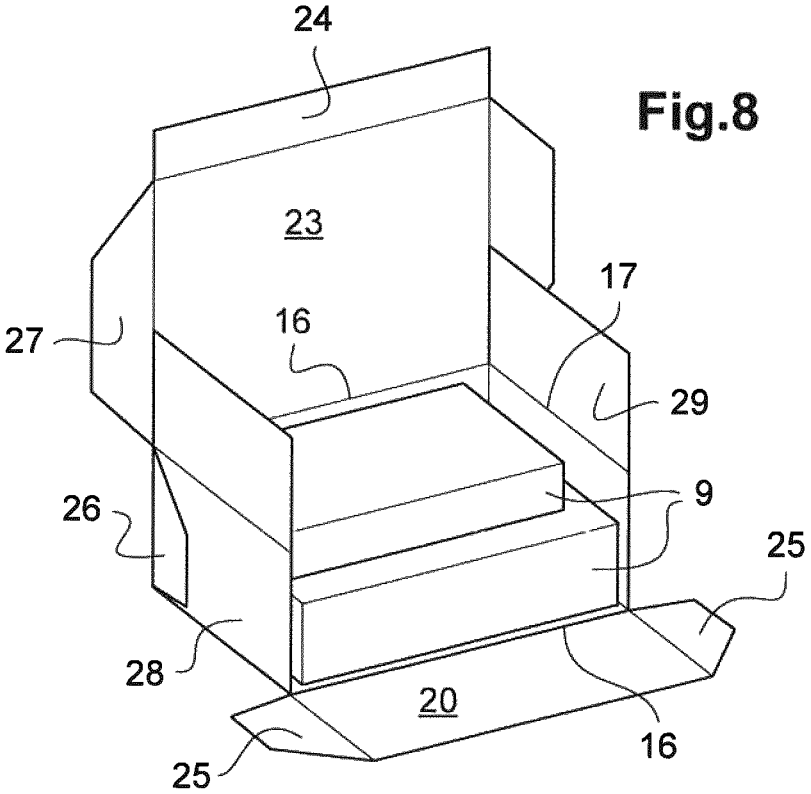

The products 9 which have been previously measured are loaded in the box through the side of the box facing the first lateral wall 22 and which is still open (FIG. 8)

In the next step illustrated in FIG. 9, the small main panel 20 is folded along a second fold line 16 and the first flaps 25 are glued on the outer face of the secondary panels 28 which form the third and fourth lateral walls of the box.

The flaps 29 are then folded toward the interior of the box along the third fold lines 17 and then coated with glue.

FIG. 10 illustrates the last steps during which the large main panel 23 is folded toward the interior of the box along a second fold line 16.

The third flap 24, coated with glue, is folded along a second fold line 16 and then pressed against the small main panel 20 together with the second flaps 27, in order to close the box.

In a variant, the second flaps 27 could be glued to the main large panel 23.

The box is then transferred to an external conveyor.

Figure 6:
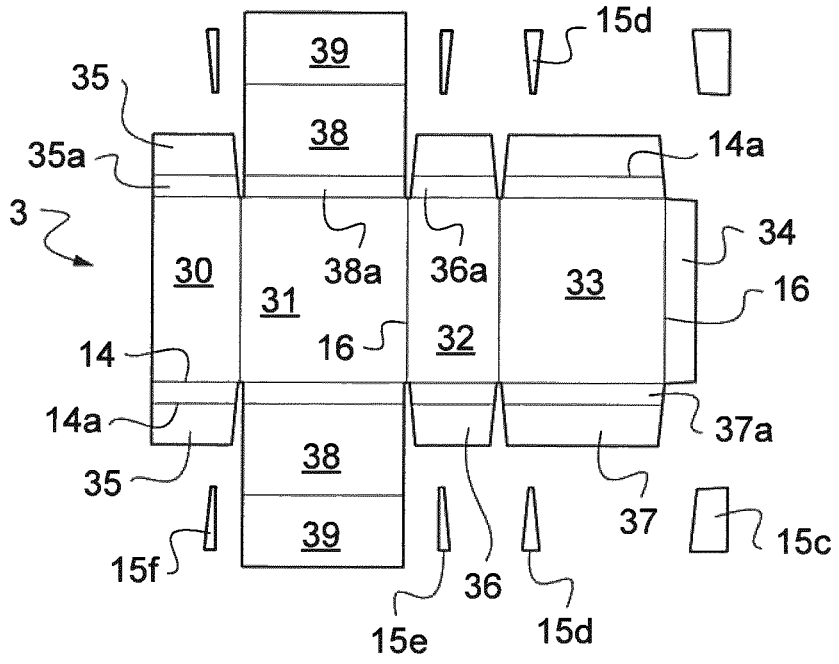
FIG. 6 is a top view of a variant of a belt formed from the blank illustrated in FIG. 1.

FIG. 6 illustrates a variant of the step illustrated in FIG. 5, ending in the belt 3.

The different parts of the belt 3 are designated by the same references as the ones used for belt 2, instead that all references of the 2× type become 3×.

With this variant, the blank 1 undergoes the steps illustrated in FIGS. 2 to 4 and, while the third fold lines 17 are created in the protruding parts, an intermediate fold line 14*a* is created on each side of the main body, between a first fold line 14 and a free longitudinal edge of the main body.

Therefore, each of the first and second flaps 35, 36 and 37 is provided with an intermediate fold line 14*a* which defines an intermediate flap 35*a*, 36*a*, 37*a* with the adjacent first fold line 14.

Moreover, each secondary panel 38 is provided with an intermediate panel 38*a*, defined between an intermediate fold line 14*a* and the adjacent first fold line 14.

FIG. 11 shows a first step of forming a box with the belt 3 illustrated in FIG. 6.

The second flaps 37 together with their corresponding intermediate flaps 37*a*, previously coated with glue, are folded along a first fold line 14 and glued to the main large panel 33.

These second flaps 37 will strengthen the box.

Then, the belt is transferred to a glue coating station and the box is partially erected as shown in FIG. 11.

The intermediate flaps 36*a* are folded along the first fold line 14 and glued to the small main panel 32.

Similarly, the intermediate panels 38*a* are folded along a first fold line 14 and glued to the large main panel 31.

The first flaps 36 and the secondary panels 38 are folded along an intermediate fold line 14*a* toward the exterior of the box, the small main panel 32 is then folded along a second fold line 16 toward the interior of the box and the first flaps 36 are glued on the secondary panels 28 to obtain the box illustrated in FIG. 11.

This box is then transferred to the filling station where the further operations are similar to the ones described with reference to FIGS. 7 to 10.

When the box is filled with the previously measured product, the intermediate flaps 35*a* are folded along a first fold line 14 and glued on the small main panel 30 and the first flaps 35 are folded toward the exterior of the box along an intermediate fold line 14*a*.

The small main panel 30 is then folded toward the interior of the box along a second fold line 16, the first flaps 35 being then glued on the outer face of the secondary panels 38.

The box is closed by folding the flaps 39 toward the interior of the box and the main panel 33 also toward the interior of the box along a second fold line 16, the third flap 34 being glued to the small main panel 30.

FIG. 12 illustrates the closed box which is obtained with this variant of the first embodiment of the invention. This box is thus provided with shock absorbers (buffers).

A second embodiment of the invention will now be described in reference to FIGS. 13 to 21.

Figure 13:
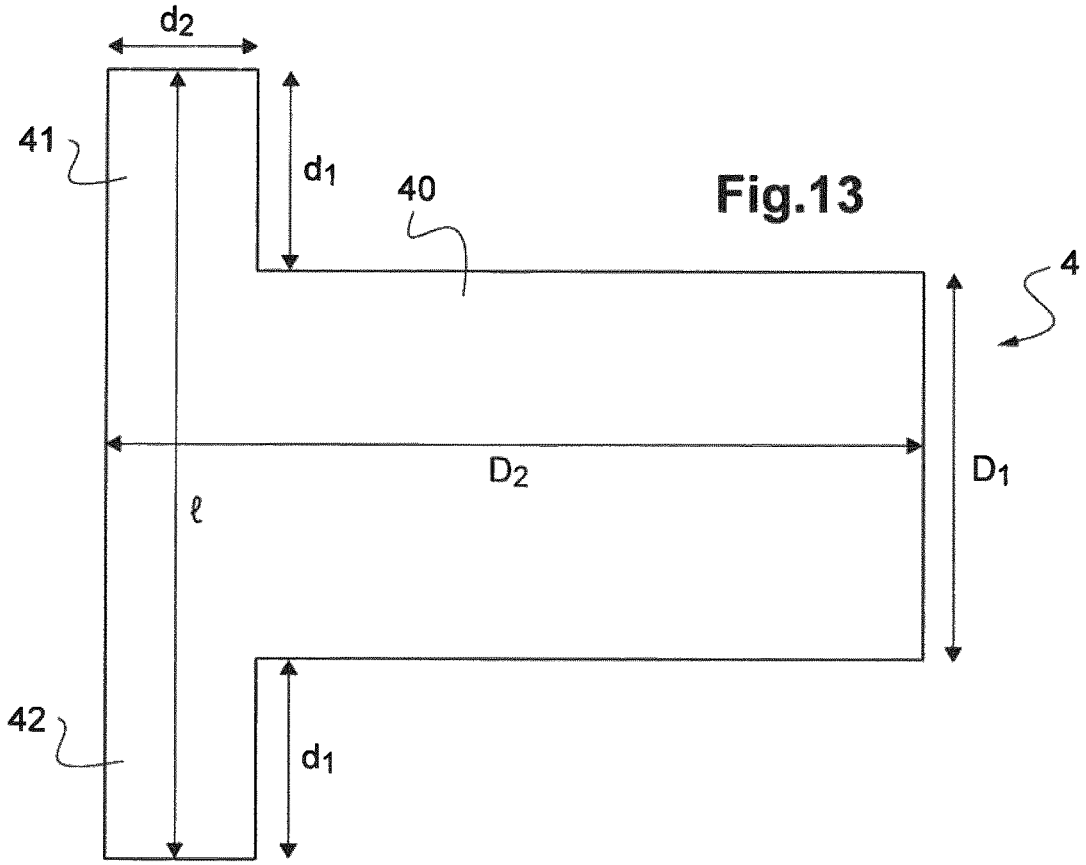
FIG. 13 is a top view of a one piece blank according to a second embodiment of the invention.

FIG. 13 shows a blank 4 according to a second embodiment of the invention which is obtained from a sheet of corrugated cardboard material and is T-shaped.

As explained previously, this blank 4 has been chosen among a predetermined number of different blanks in accordance with the size of the product(s) to be packed.

The choice is made so that the size and shape of the blank are adapted to the size of the final box in order to reduce waste material.

Figure 17:
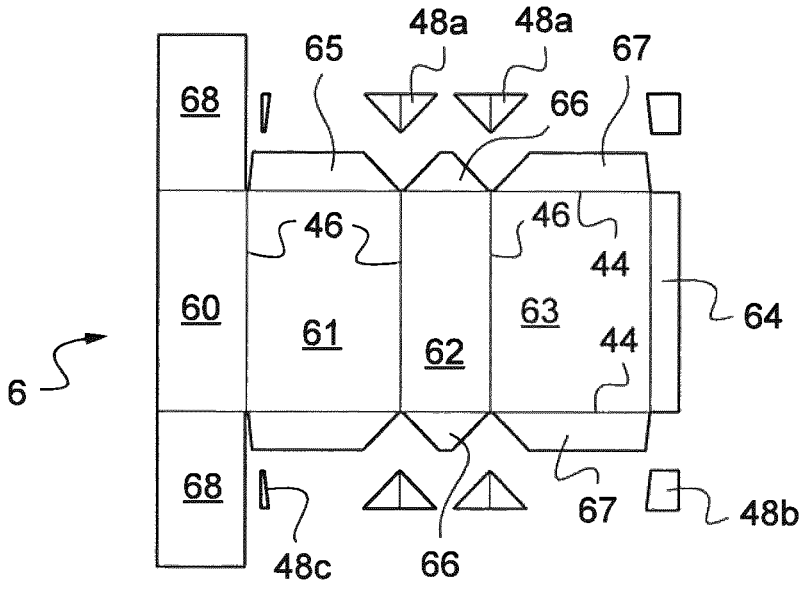

By implementing the method according to the invention, a belt 6 as illustrated in FIG. 17 can be obtained from this blank 4, this belt being used to form a box having a polygonal cross section, with a length L, a width W and a height H, determined as explained previously.

This blank 4 comprises a main rectangular body 40 extending in a longitudinal direction and two protruding rectangular parts 41, 42 extending in a transverse direction (perpendicular to the longitudinal direction).

FIG. 13 shows that the protruding parts 41 and 42 are symmetrical with regard to the main body 40 (or its longitudinal direction).

The blank 4 thus includes a first (long) branch formed by the main body 40 and a second (short) branch formed by the protruding parts 41, 42, this second branch corresponding to the T-bar.

The main body 40 has a first dimension D1 (width of the first branch) along its transverse direction which is larger than the length L of the box and a second dimension D2 along its longitudinal direction (length of the first branch) which is larger than twice the width W plus the height H of the box (2 W+2 H).

The example of box according to the invention which is described later includes flaps (described later) so that the second dimension D2 is larger than 2 W+2 H+w, where w is the width of a third flap and D1 is larger than L+2 w', where w' is the width of each of first and second flaps.

Each of the protruding parts 41 and 42 has a first dimension d1 along the transverse direction of the main body which is larger than the width W of the box and a second dimension d2 along the longitudinal direction of the main body which is larger than the height H of the box.

Therefore the length l of the T-bar (l=D1+2 d1) is larger than the length L plus twice the width W of the box (L+2 W) and its width (d2) is larger than the height H.

Roughly speaking the main body 40 has a second dimension D2 (length of the first branch) large enough in view of the width W and the height H of the final box, while the T-bar (short branch) is large enough in view of the length L and the height H of the final box.

As explained previously, the choice of a blank 4 between the predetermined number of different available blanks is made so that the chosen blank has the dimensions closest to the ones of the final box in order to reduce the waste.

After extraction from a stack of blanks, the blank is transferred to a conveyor which is driven in order to have a linear motion.

It will now be described how the blank 4 illustrated in FIG. 13 is processed in order to obtain a belt 6 as illustrated in FIG. 17.

Figure 14:
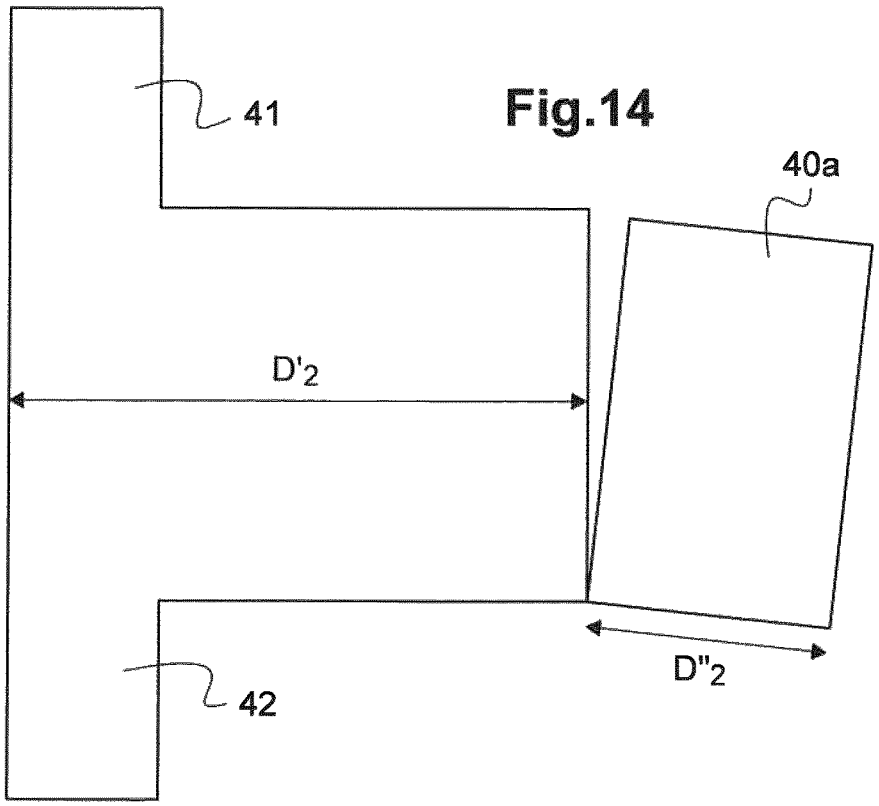
FIGS. 14 to 17 are top views of the blank of FIG. 13 illustrating steps of forming a belt from the blank.

FIG. 14 shows a first step during which the blank 4 is cut to reduce its second dimension D2 or the length of the first branch of the T, so that this length D2' is now equal to the sum of the width w of the third flap plus twice the width W and the height H (D2'=2 H+2 W+w).

Figure 15:
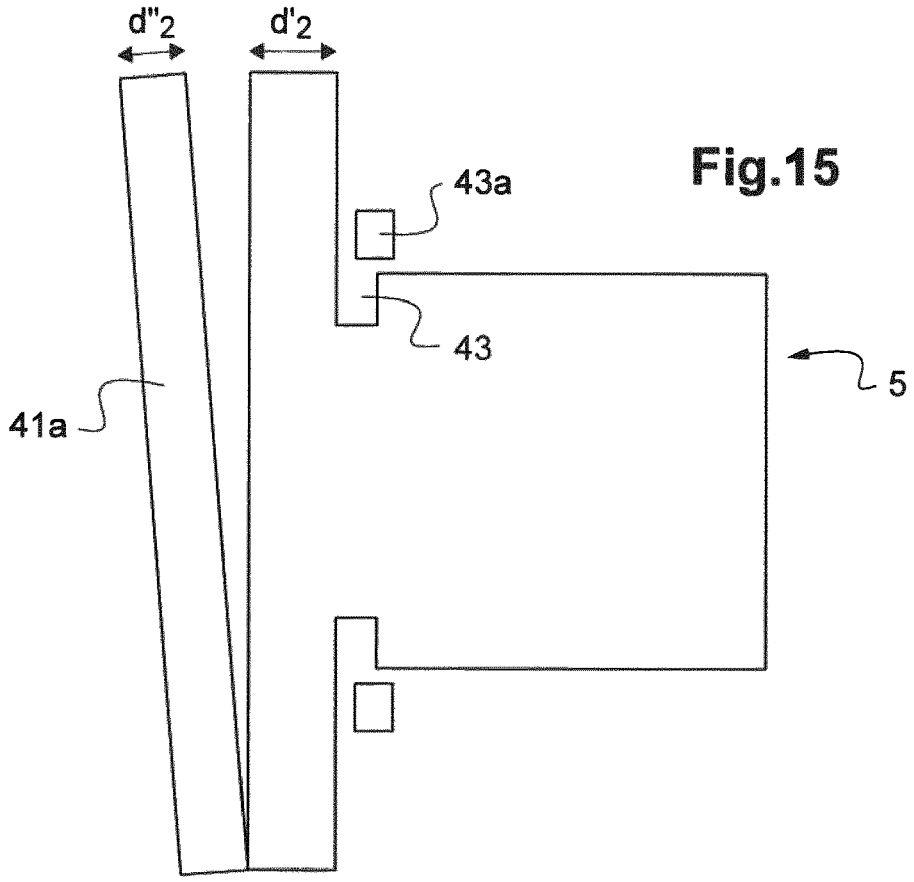

This cutting step creates a waste 40*a* having a second dimension D2"=D2−2H−2W−w. FIG. 15 illustrates another step of the method according to the invention during which the second dimension d2 (width) of the T-bar is reduced so as to correspond to the height H of the box.

Waste 41*a* thus created has a second dimension d2" equal to d2 minus H (d2"=d2−H).

Further cuts are made between the main body of the blank 5 and the protruding parts to create slots, these cuts generating wastes 43*a*. They facilitate the following operations but can be omitted.

Figure 16:
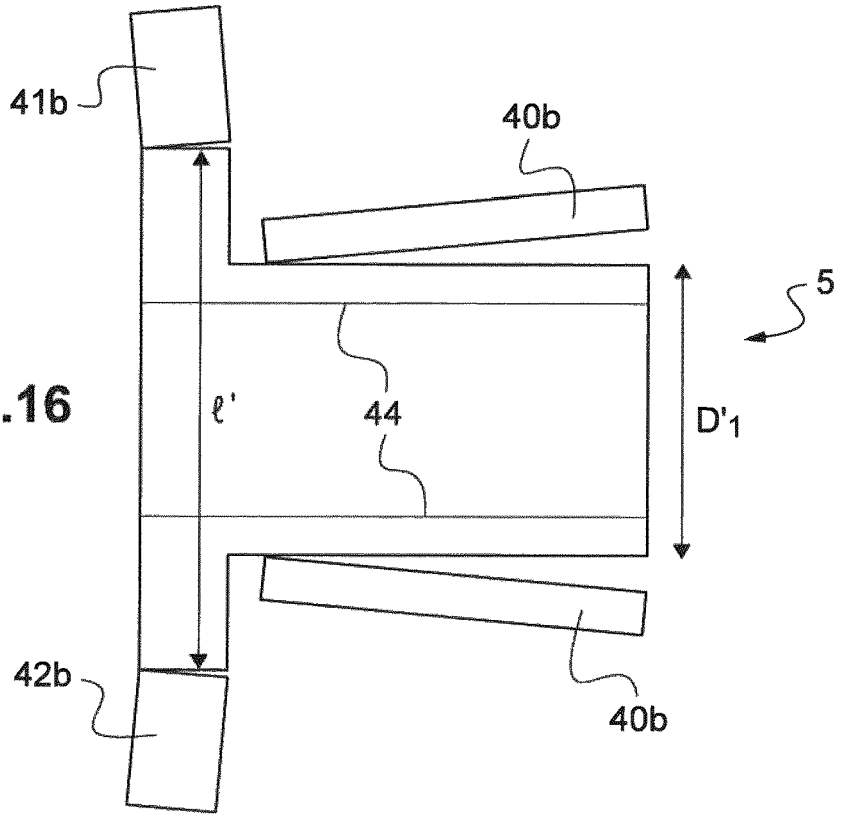

During the further step illustrated in FIG. 16, the blank 5 is transferred by the conveyor and during this transfer, the width of the first long branch (first dimension D1) and the length l of the second branch are reduced.

More specifically, the first dimension D1' of the first branch corresponds now to the length L of the final box and twice the width w' (D1'=L+2 w') and two wastes 40*b* are created.

The length of the T-bar is also reduced so that the modified length l' corresponds to the length L plus twice the width W of the box (l'=L+2 W).

These cuts create two wastes referenced 41*b* and 42*b*.

Moreover, during this cutting steps, first folding lines 44 are created along the length of the first branch (longitudinal direction).

As explained later, these first fold lines 44 will defined the first and second flaps.

The distance between both first fold lines 44 is equal to the length L of the final box.

The modified blank obtained at the end of this step is transferred by the conveyor and FIG. 17 illustrates the next step during which second fold lines 46 are created in the main body which defines four main rectangular panels 60 to 63 and the third flap 64 having the width w.

The four main rectangular panels 60 to 63 have all the same length which is equal to the length L of the final box but they have different widths.

The width of the panel 60 and 62 (small panels) is equal to the height H of the box while the width of the panels 61 and 63 (large panels) is equal to the width W of the box.

FIG. 17 also shows that the main body is cut on each of its longitudinal sides and in line with the second fold lines 46.

These cuts extend between the free longitudinal edge of the main body and the adjacent first folding lines 44 and they create wastes 48*a* to 48*c*.

These cutting steps define two pairs of first flaps 65 and 66 connected on the opposing sides of the large main panel 61 and of the small main panel 62, by means of a first fold line 44.

Moreover a pair of second flaps 67 is provided on the opposing sides of the large main panel 63, these flaps 67 being also connected to the main panel 63 by means of a first fold line 44.

The width of the first flaps 65, 66 and second flaps 67 is w'.

The protruding parts form, on each side of the small main panel 60, a secondary panel 68, each of them being connected to the main panel 60 by means of a first fold line 44.

Figure 19:
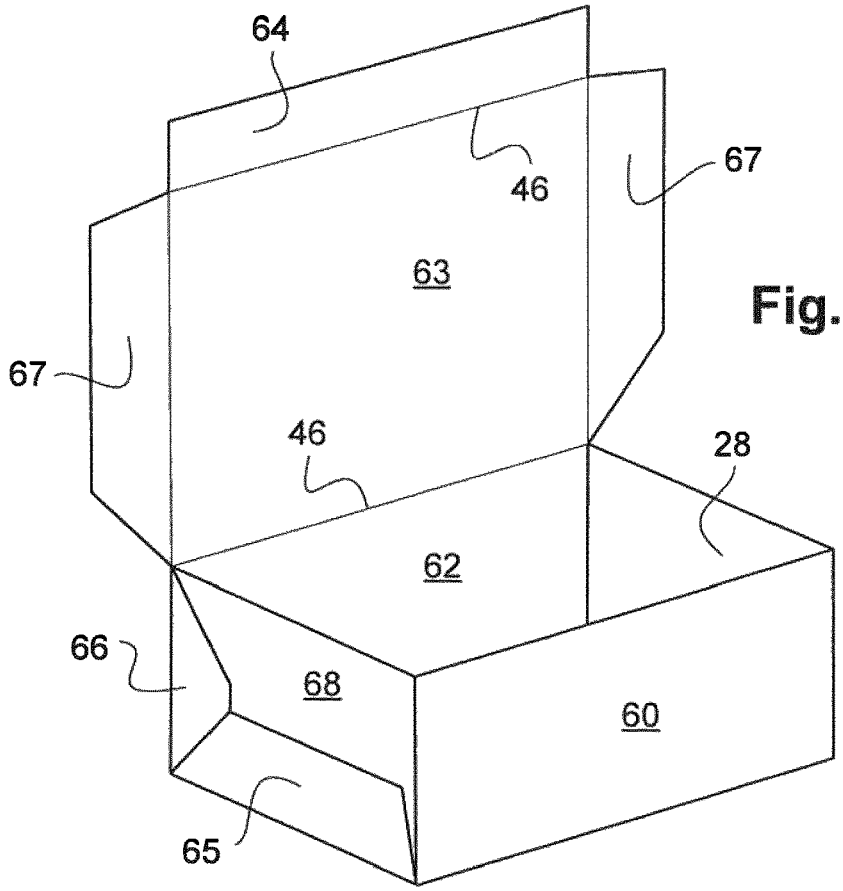
FIG. 19 is a perspective view of a box partially erected and made from the belt illustrated in FIG. 17.
Figure 20:
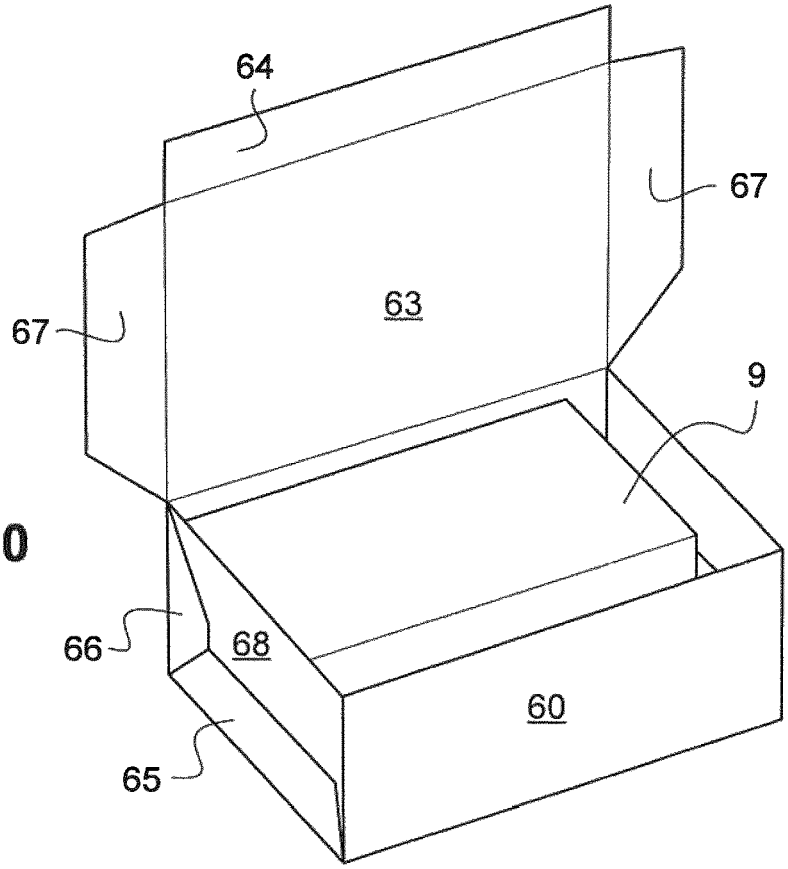
FIGS. 20 and 21 are perspective views having the packing of items in the box illustrated in FIG. 19.

After its formation, the belt 6 is transferred for glue coating and the box is partially erected as shown in FIG. 19.

To this end, each of the secondary panels 68 is folded along a first fold line 44, then the small main panels 60 and 62 are folded along a second fold line 46 and finally, the first flaps 65 and 66 are glued on the outer face of the secondary panels 68.

FIG. 19 shows that the main large panel 61 will form the bottom of the box while the other large main panel 63 will form the top of a box.

Moreover, the small main panels 62 and 60 will form the first and second lateral walls of the box while the secondary panels 68 form the third and fourth lateral walls of the box.

After having been partially erected as shown in FIG. 19, the box is transferred to the filling station.

The products 9 which have been previously measured are loaded in the box through its top opening and in the next step, the large main panel 63 is folded toward the interior of the box along a second fold line 46.

Figure 21:
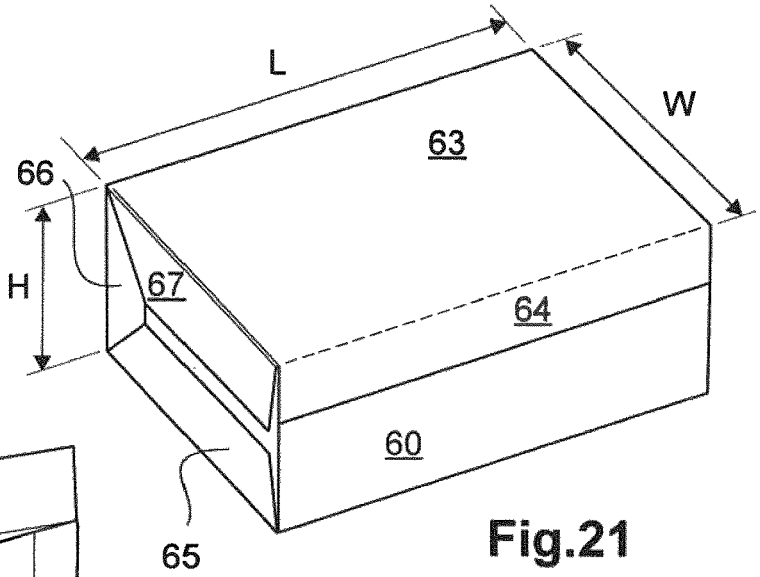

The third flap 64, coated with glue, is folded along a second fold line 46 and then pressed against the small panel 60, together with the second flaps 67, in order to close the box (FIG. 21).

In a variant, the second flaps 67 are glued to the main panel 63.

The box is then transferred to an external conveyor.

Figure 18:
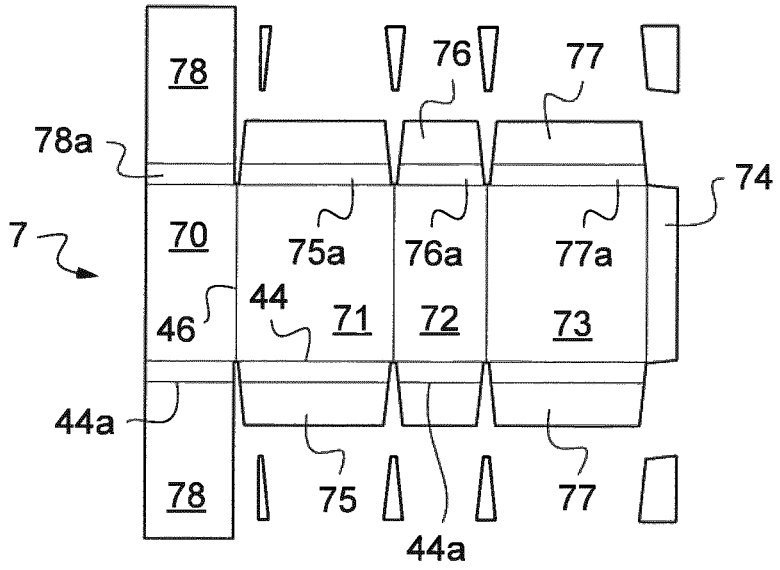
FIG. 18 is a top view of a variant of a belt formed from the blank illustrated in FIG. 13.

FIG. 18 illustrates a variant of the step illustrated in FIG. 17, ending in the belt 7.

The different parts of the belt 7 are designated by the same references than the ones used for the belt 6, instead that all references of the 6× type become 7×.

With this variant, the blank 5 undergoes the steps illustrated in FIGS. 13 to 16 and, while the first fold lines 44 are created, an intermediate fold line 44*a* is created on each side of the main body, between a first fold line 44 and a free longitudinal edge of the main body.

FIG. 18 shows that similar intermediate fold lines 44*a* are created in the T-bar.

Therefore, each of the first and second flaps 75, 76 and 77 (or each of the secondary panels 78) is provided with an intermediate fold line 44*a* which defines an intermediate flap 75*a*, 76*a*, 77*a* (or an intermediate panel 78*a*) with the adjacent first fold line 44.

Figure 22:
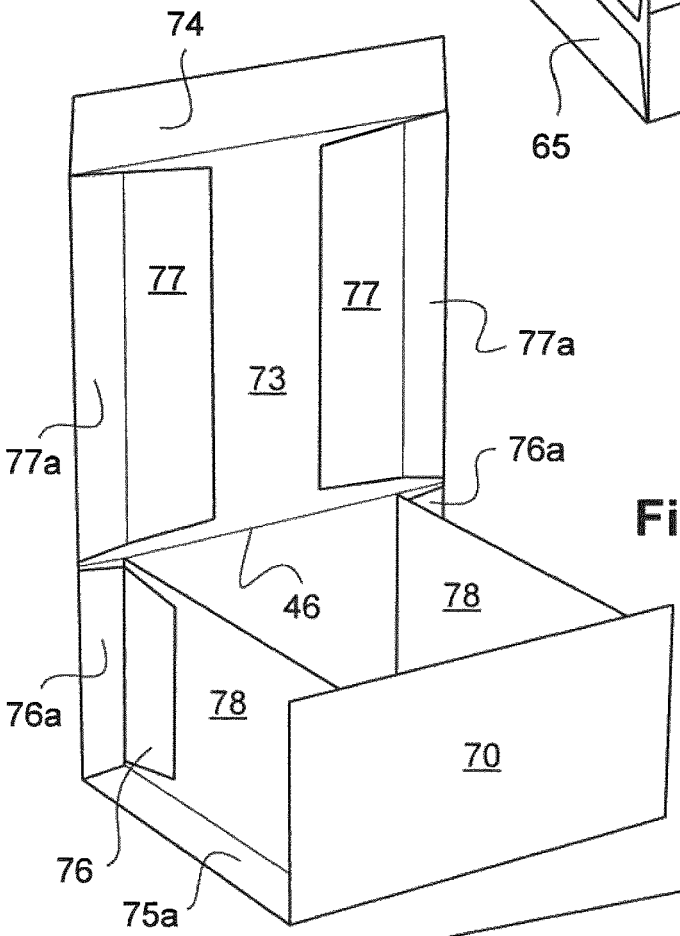
FIGS. 22 and 23 are perspective views showing the erection of a box made from the blank illustrated in FIG. 18 and its closing.

FIG. 22 shows a first step of forming a box with the belt 7 illustrated in FIG. 18.

The first flaps 75 and the second flaps 77 together with their corresponding intermediate flaps 75*a*, 77*a*, previously coated with glue, are folded along a first fold line 44 and glued to the corresponding main large panel 71, 73.

The intermediate panels 78*a* are folded along a first fold line 44 and glued to the central panel 70 which is folded along a second fold line 46.

The intermediate flaps 76*a* are folded along a first fold line 44 and glued to the small main panel 72 which is folded along a second fold line 46, the first flaps 76 being then glued to the secondary panels 78 to obtain the box illustrated in FIG. 22.

This box is then transferred to the filling station where the further operations are similar to the one previously described.

When the box is filled with the previously measured products, the main large panel 73 is folded along a second fold line 46 and the flap 74 is glued on the small main panel 70.

Figure 23:
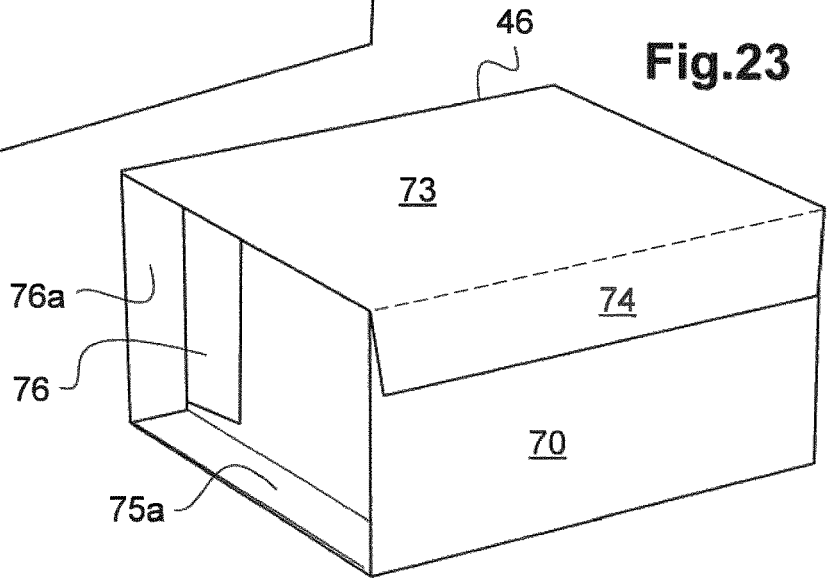

FIG. 23 illustrates the closed box which is obtained with this variant of second embodiment of the invention.

This box is thus provided with shock absorbers (buffers).

It can be deduced from FIGS. 10, 12, 21 and 23 that a box according to the invention can be opened by the final client by tearing off the third flap, and where appropriate (FIG. 21), the second flaps.

After its opening, the lateral walls of the box are still erected, contrary to the packagings of the prior art and the box can be thus reused.

Suitable means can be provided on these flaps to avoid their deterioration during the opening of the box so that it can be easily reused by the final client.

Reference will now be made to FIGS. 24 to 36D in order to describe an example of a machine according to the invention which enables the manufacture of a box sized to define a housing space for products which perfectly fits the size of these products.

Figure 24:
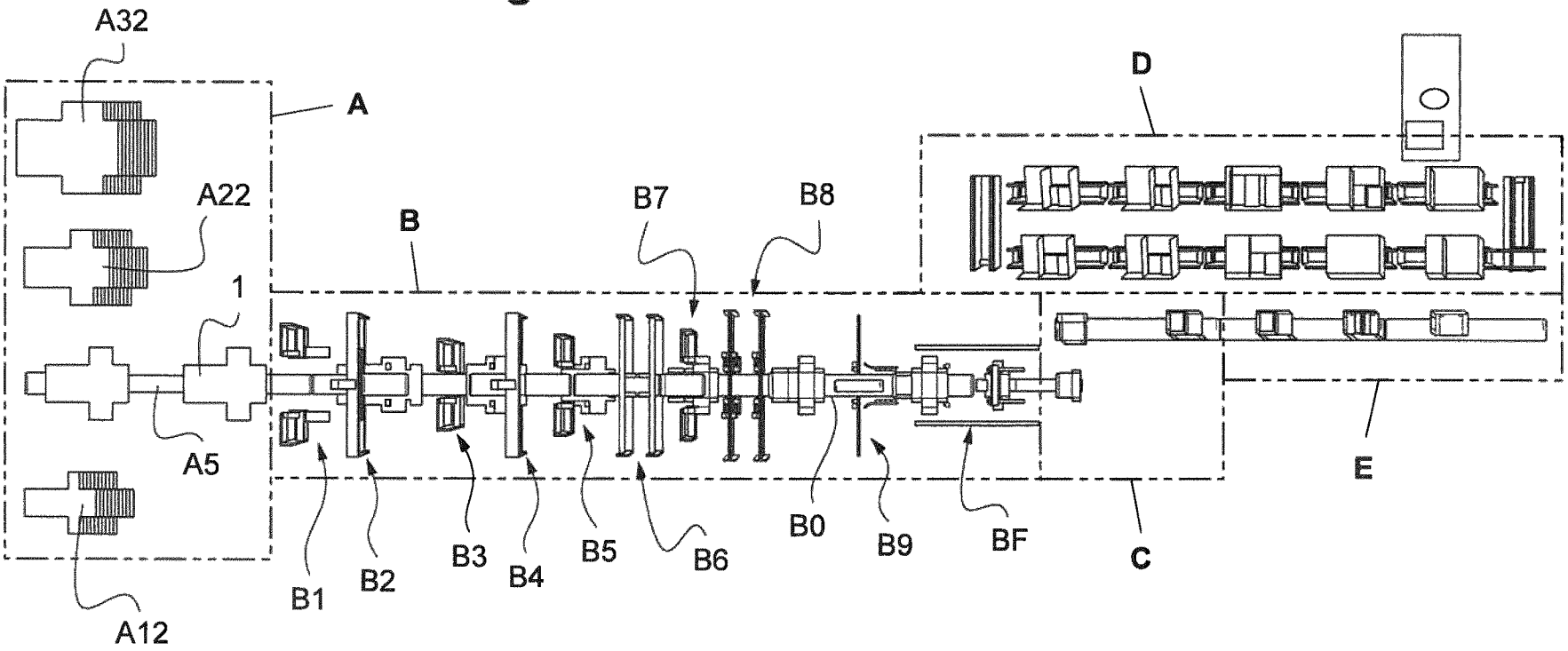
FIG. 24 is a plan view of an embodiment of a machine according to the invention, comprising units A to E.
Figure 25:
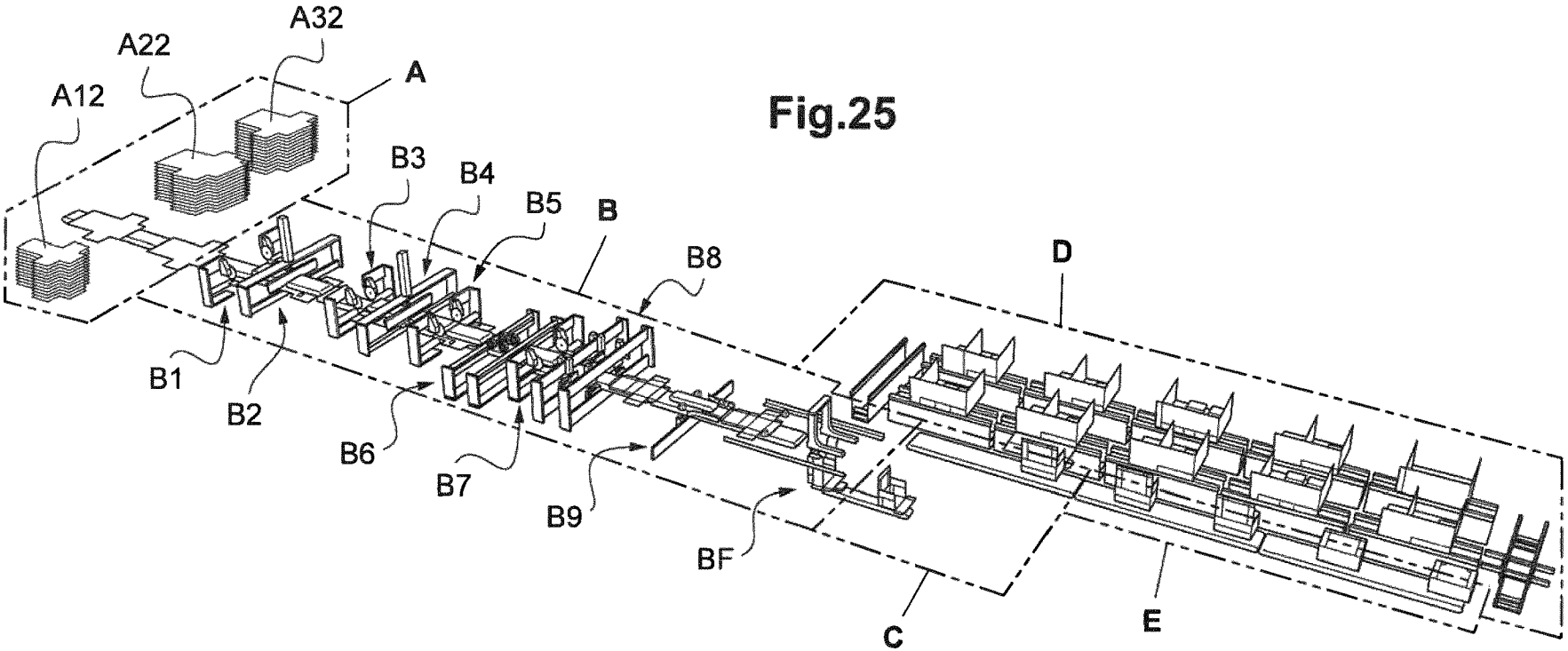
FIG. 25 is a perspective view corresponding to FIG. 24.

FIGS. 24 and 25 show an overview of this machine which comprises five units:

Unit A is a storage and feeding unit which includes three stacks of blanks, each stack corresponding to one type of blank.

Unit A will be further described in reference to FIGS. 26 and 27.

Unit B is a transformation and box forming unit in which a blank is transformed into one belt. It will be described in reference to FIGS. 28 to 33.

Unit C is a filling unit.

Unit D is an order preparation unit which will be described in reference to FIGS. 34 to 36D.

Unit E is a box closing unit.

The general functioning of the machine is as follows:

Once a customer has sent an order for products, this order is prepared and an operator puts the products in a metallic crate, each crate is labelled with a barcode or an RFID tag.

The management system of the machine links the customer's order to the crate label (Unit D).

The crate is then transferred to a filling position and during this transfer, the products are measured to determine the size of the RSP box (Unit D). In other words, the length L, the width W and the height H of the box are chosen so that the box is closely adapted to the size of the products to be packed.

On the basis of this determined box size, a blank is chosen and picked up from one of the three types of blank (T1, T2 or T3) which are stored in Unit A and transferred to Unit B. During this stage, a barcode may be inscribed by laser or print on the blank, in order to link the customer's order to the chosen blank.

Therefore, the customer's order is linked to a crate housing the products corresponding to the order and to the RSP box which will be created from the chosen blank, by means of barcodes.

The chosen blank is then transformed in Unit B in order to create a belt which is then formed to obtain the RSP box which is partially erected (Unit B) and transferred to the filling Unit C.

The filled box is then closed and transferred to a shipment unit (Unit E).

The functioning is described in relation with an order for several products, but it is identical if the order includes only one product.

The following description is made for a blank 1 of the type illustrated in FIG. 1, which leads to a cross shaped belt. However, the machine could be easily adapted to create a belt and to form a box with a blank of the type illustrated in FIG. 13.

Unit A will be now further described in reference to FIGS. 26 and 27.

Unit A mainly comprises three movable pallets A1 to A3, an extraction device A4 and a transfer device A5.

Each of the movable pallets A1 to A3 includes a support A10 to A30 which is supported by elevator means A11 to A31.

On each pallets, are stacked blanks of the same type.

For illustration purposes only, the three types of blank are defined to be able to obtain boxes having:

a length L ranging from 180 mm to 455 mm, a width W ranging from 140 mm to 340 mm and a height H ranging from 25 mm to 265 mm.

Any box having a size within these three ranges can be obtained from a blank chosen among three different types T1, T2 and T3, defined in the following table.

| | D1 | D2 | D21 | d1 | d2 | 1 |
|---|---|---|---|---|---|---|
| T1 | 400 | 594 | 70 | 160 | 210 | 720 |
| T2 | 460 | 814 | 140 | 160 | 250 | 780 |
| T3 | 620 | 1252 | 270 | 290 | 340 | 1200 |

The blanks of the T1 type (and of the T2 type) are stacked in one pile on a 800×1200 pallet.

Blanks T3 are also stacked in one pile but on a 1300×1200 pallet.

The height of all the corresponding stacks A12 to A32 is of 1800 mm.

FIG. 26 represents the Unit A at the beginning of the functioning of the machine. Therefore, the three stacks A12 to A32 have the same height.

The extraction device A4 includes an extraction arm A40 which extends almost vertically, i.e. almost perpendicular to the plane of the pallets A11 to AS31.

This extraction arm is providing with handling means A400 at its free end which support suction pads A401.

This arm is movable along its own (vertical) axis and also along a horizontal support A41 which is perpendicular to its axis.

As explained previously, once the ordered products are measured and the size of the RSP box is defined, a blank is chosen among the three types of blank T1 to T3.

A software can be used to determine from the size of the RSP box (L, W, H), the size of the first and second belts and from the latter, which type of blank is adapted to said box.

In the example illustrated in FIG. 26, a blank T2 is chosen, therefore, the extraction arm A40 is positioned above the stack A22.

The arm A40 will be then operated to move downwards so that the suction pads A401 come into contact with the highest blank in the stack and take it.

The arm A40 is then operated to deposit the blank T2 on the transfer device A5.

FIG. 27 illustrates Unit A at a further stage of the functioning of the machine where the arm A40 is positioned above the transfer device A5.

It is understood that after its deposition on the transfer device A5, a blank is transferred to Unit B on conveyor B0.

FIG. 27 shows that each movable pallet A1 to A3 is controlled so that the top of each stack A12 to A32 remains at the same level after the removal of several blanks.

For that purpose, Unit A includes a laser cell which measures the position of the top of each stack and operates accordingly each elevator A11 to A31.

Figure 28:
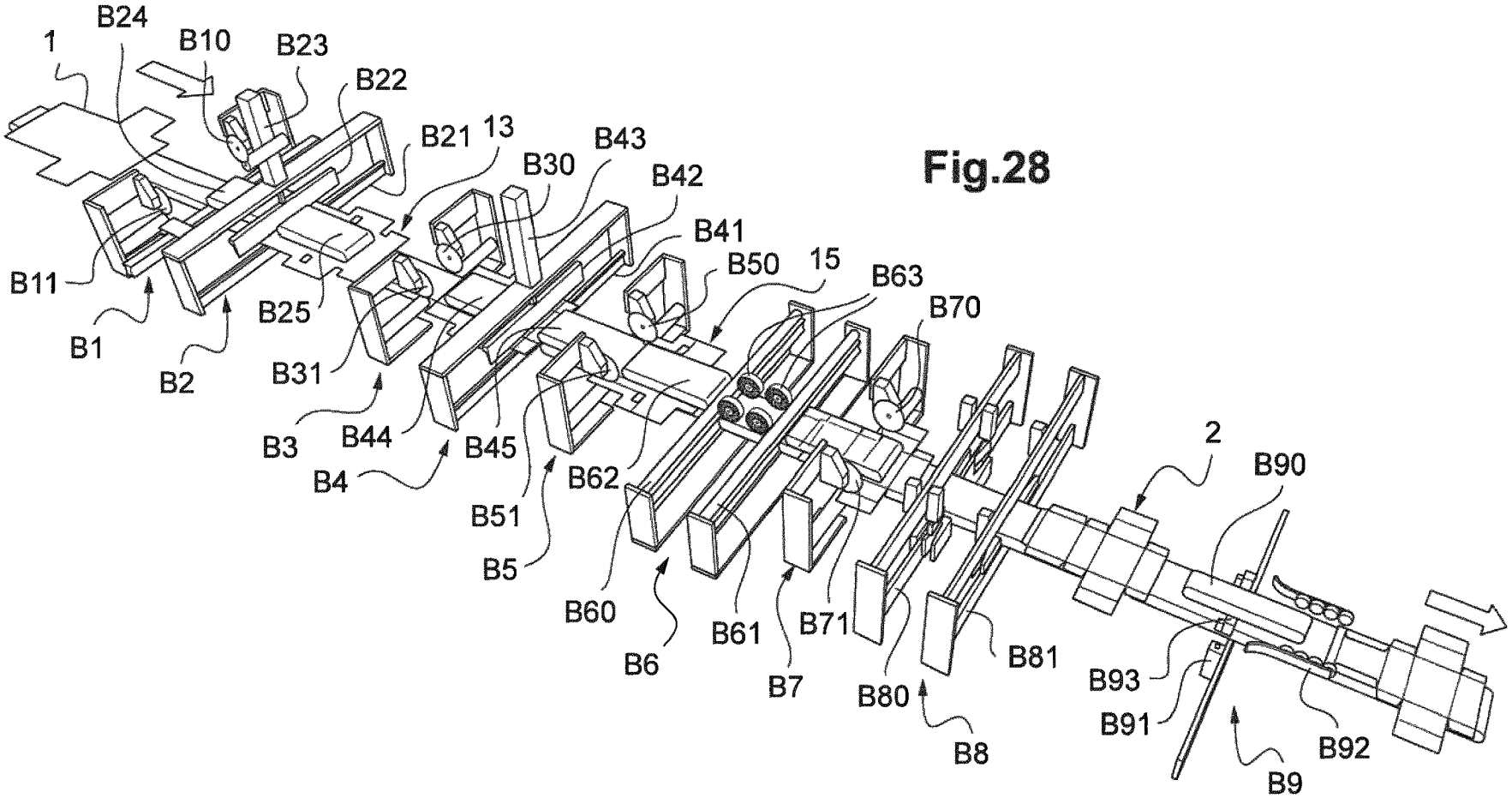
FIG. 28 is a perspective view of the transformation line of unit B (Blank transformation and box forming Unit).

The blank 1 will then goes through the transformation line of Unit B which is illustrated in FIG. 28.

FIG. 28 shows that the transformation line comprises nine stations B1 to B9 through which blank 1 is transferred by means of the conveyor B0.

The blank 1 is in a first step cut in station B1 (width sizing) so that the length $\underline{l}$ of the (short) second branch of the cross is reduced. After cutting, it is equal to the sum of the length L of the final box plus twice its height H plus twice the width w" of the flaps 29 ($\underline{l}'$=L+2H+2w").

Figure 29:
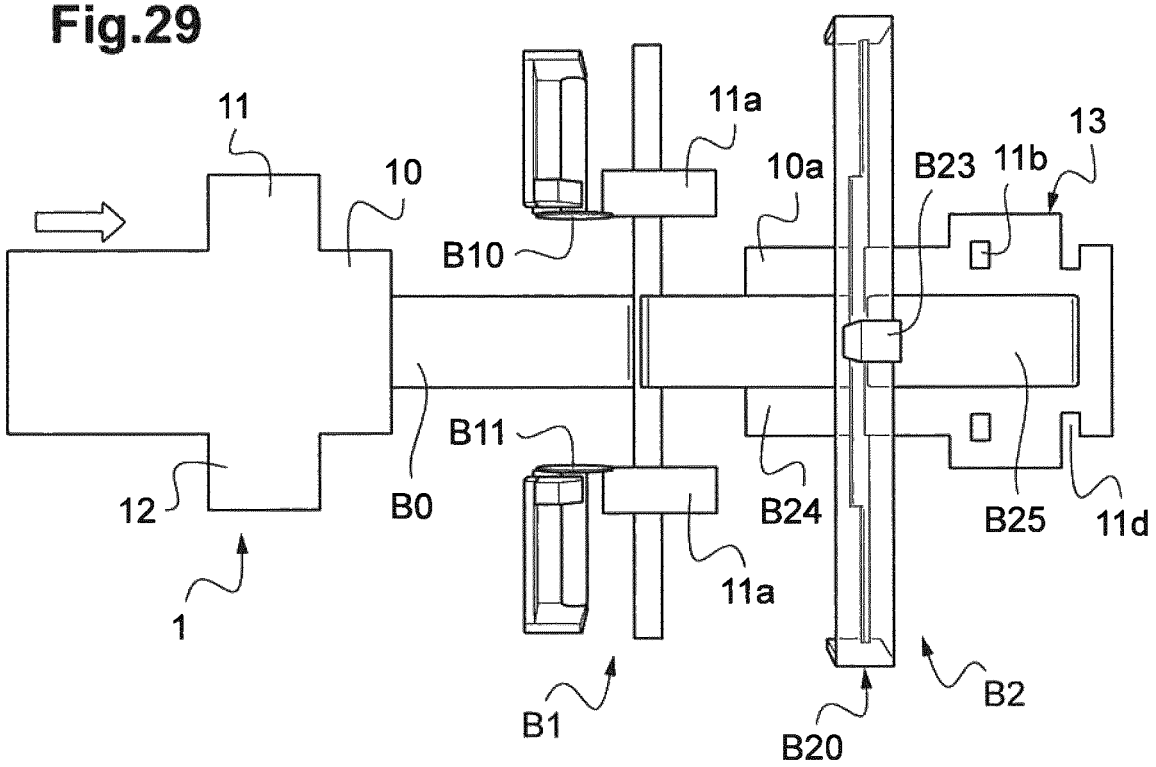
FIG. 29 is a top view of a first cutting device and of a second cutting device illustrated in FIG. 28.

Station B1 is illustrated in FIG. 29. It comprises two rotary cutters B10 and B11 which are put symmetrically with regard to conveyor B0 and cut the protruding parts 11 and 12 of the blank 1, this cutting step creating waste 11*a*.

The blank 1 then enters the station B2 and, in a second step, it is cut to reduce the length of its first branch (second dimension D2 which becomes D'2) and more specifically D22, so that the distance D22' corresponding to the difference between D2' and D21 is now equal to the sum of twice the width W plus the height H of the box, plus the width w of the third flap (D22'=H+2 W+w).

In other words, this cut of the main body 10 reduces the length of the large branch of the cross and creates waste 10*a*.

Station B2 comprises a two part cutting device B20 with a stationary part B21 and a movable part B22 which is moved vertically by means of a supporting arm B23.

When the first body 10 enters the station B2, the cutting parts are spaced apart and the blank 1 goes through this space.

It is then held in position by means of pressure conveyors B24 and B25 and the movable cutting part B22 is moved downwards in order to cut the blank 1 (guillotine action).

As mentioned previously with reference to FIG. 2, during that step, further cuts are made in the blank 10 which create holes 11*b* and notches 11*d*.

In a third step, the modified blank 13 goes through station B3 (first fold lines creation) in which first fold lines 14 are created along the longitudinal direction of the modified blank (or along the first branch of the cross) as illustrated in FIG. 3.

Figure 30:
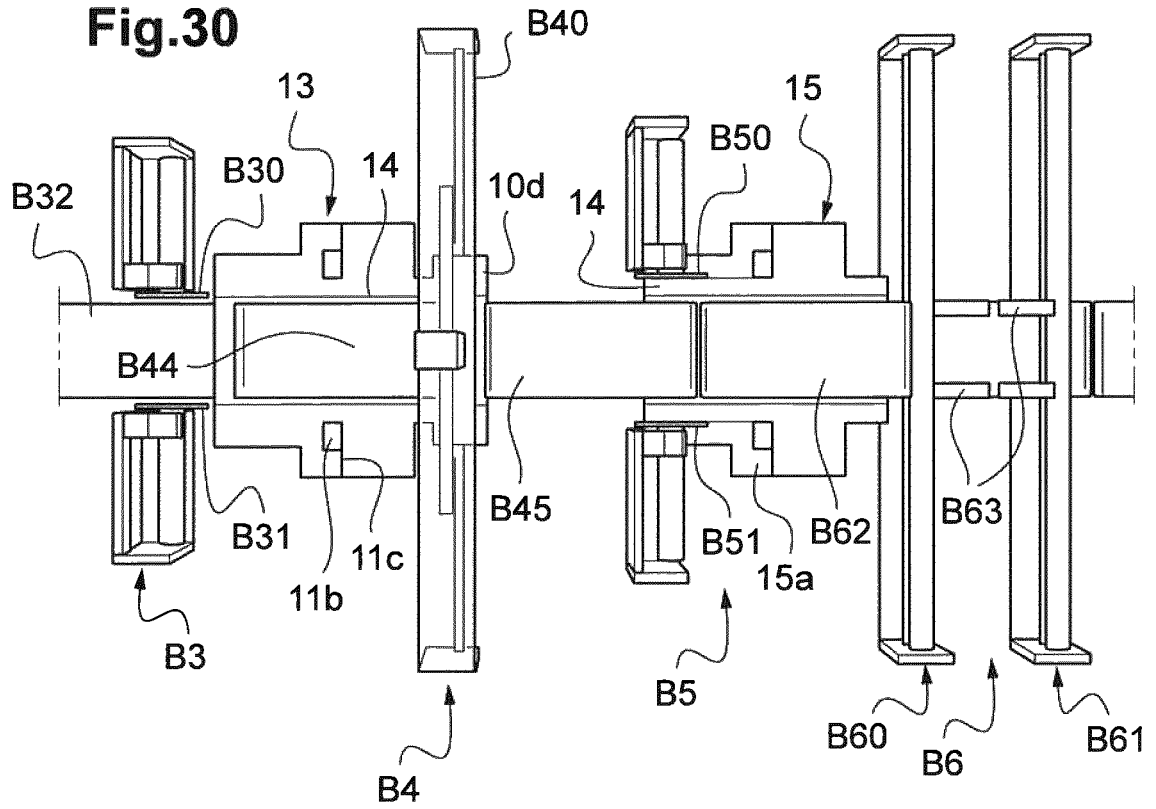
FIG. 30 is a top view of a device for creating first fold lines, of a third and a fourth cutting devices and a device for creating second fold lines, as illustrated in FIG. 28.

As shown in FIG. 30, the station B3 includes two rotary devices B30 and B31 which are spaced apart (the distance between them is equal to the length L of the final box) and which enables the creation of the first folding lines 14. The rotation axes of the devices B30 and B31 are perpendicular to the conveyor B0.

Station B3 also includes a pressure conveyor B32 located between rotary devices B30 and B31.

The pressure conveyor B32 enables to hold the modified blank 13 against the conveyor B0, during the creation of the first folding lines 14 (see FIG. 3), to control its position on the conveyor B0.

The modified blank 13 is then transferred by conveyor B0 through station B4.

During this transfer, cuts 11*c* are made in the modified blank by appropriate cutting means (not illustrated).

In station B4, during a fourth step (as illustrated in FIG. 3), the modified blank is cut to reduce the length of its first branch again but on the side of the blank opposite the one already cut in the second step.

With this cut, the longitudinal dimension D21 is reduced and becomes D21' which corresponds to the height H of the final box.

Station B4 includes a two part cutting device B40 (B41, B42) and pressure conveyors B44 and B45 which are similar to the ones described with reference to station B2 and they will not be described again.

The modified blank 15 is then transferred by conveyor B0 through station B5 and, in a fifth step, further cuts are made to adjust the first dimension D1 of the main body and the second dimension d2 of the protruding parts 11 and 12.

With these cuts, the first dimension of the main body (width of the first branch) is reduced to D1' which is equal to the length L of the box and twice the width w' of a first or second flap (D1'=L+2w') while the second dimension d2' of each protruding part (width of the second branch) is now equal to the width W of the final box.

The station B5 comprises two rotary cutters B50 and B51 which are put symmetrically with regard to conveyor B0.

In a sixth step, second fold lines 16 are created along the width of the main body, by means of the station B6.

The station B6 includes two crease shafts B60, B61 which are spaced apart, extend perpendicular to the conveyor B0 and enable the creation of the second fold lines.

Station B6 also comprises a pressure conveyor B62 located in front of crease shaft B60 and, between crease shafts B60 and B61, four no-crush wheels B63, to maintain pressure on the modified blank and control its position on the conveyor B0.

Figure 31:
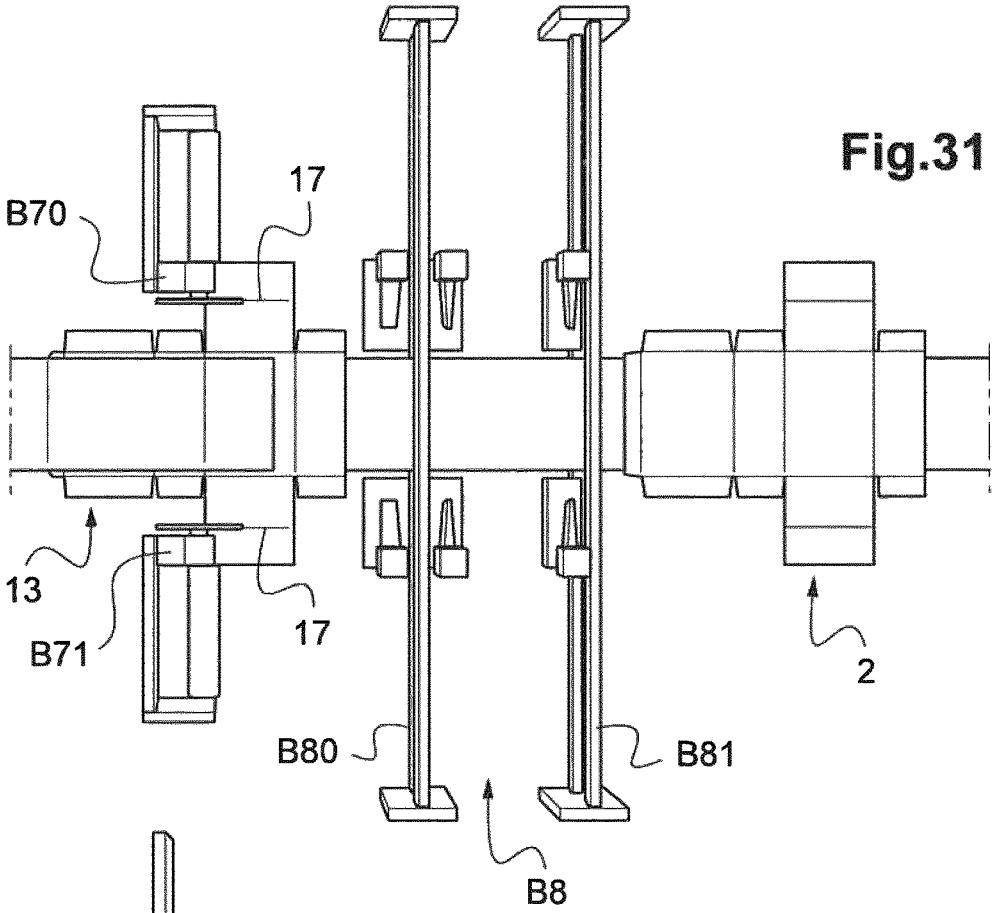
FIG. 31 is a top view of a device for creating third fold lines and of a fifth cutting device, illustrated in FIG. 28.

FIG. 31 illustrates stations B7 and B8 of the transformation line.

In station B7, third fold lines 17 are created along the longitudinal direction of the modified blank and in the protruding parts of the blank (see FIG. 5).

Therefore, station B7 is similar to station B3 and it includes two rotary devices B70 and B71 which are spaced apart (the distance between them is equal to L+2 H).

The modified blank is then transferred by conveyor B0 trough station B8 which is a cutting device which includes slot and flap cutting means B80 and B81, together with holding means (for instance no-crush wheels, not illustrated).

The holding means are pressed on the modified blank to hold it in position while two pairs of slots are cut. The blank is then moved and another pair of slots is created while the third flap 24 is also cut at its two free ends.

As shown in FIG. 5, slots are cut in line with a second fold line 16.

At this end of this step, is obtained the belt 2 illustrated in FIG. 5.

Figure 32:
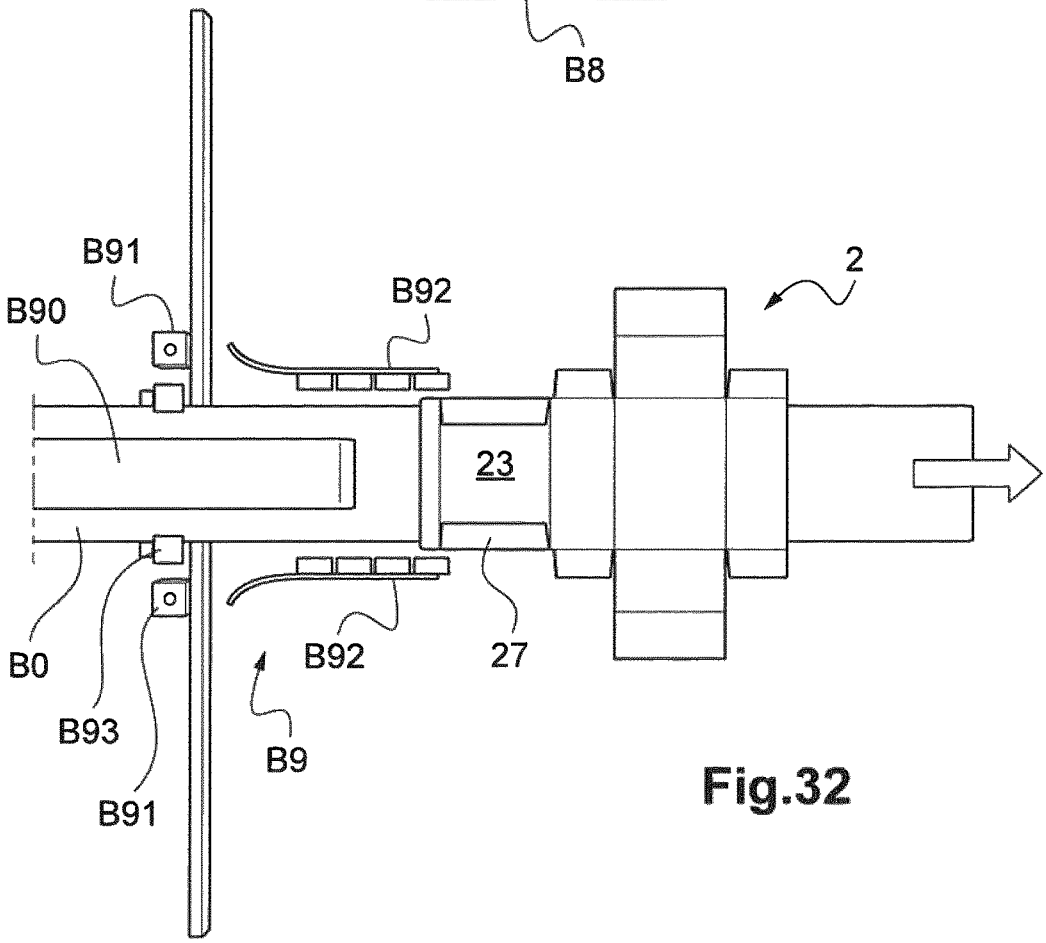
FIG. 32 is a top view of a flap folding device as illustrated in FIG. 28.

Reference is now made to FIG. 32 which illustrates the station B9 (flap folding).

FIG. 32 shows that the belt 2 is transferred to station B9 by the conveyor B0.

Station B9 comprises a pressure conveyor B90 and means B93 for coating with glue the second flaps 27 or the main panel 23 of the belt 2, such as hot-melt guns.

Station B9 also comprises means B91 and B92 which are operated to fold the second flaps 27 on the large main panel 23. To this end, the second flaps are folded at an angle 90° with means B91 while means B92 include guides and rollers for ending the folding of the flaps and pressing them on main panel 23.

The belt 2 is then transferred by conveyor B0 to the forming station BF which will be described in reference to FIG. 33.

Figure 33:
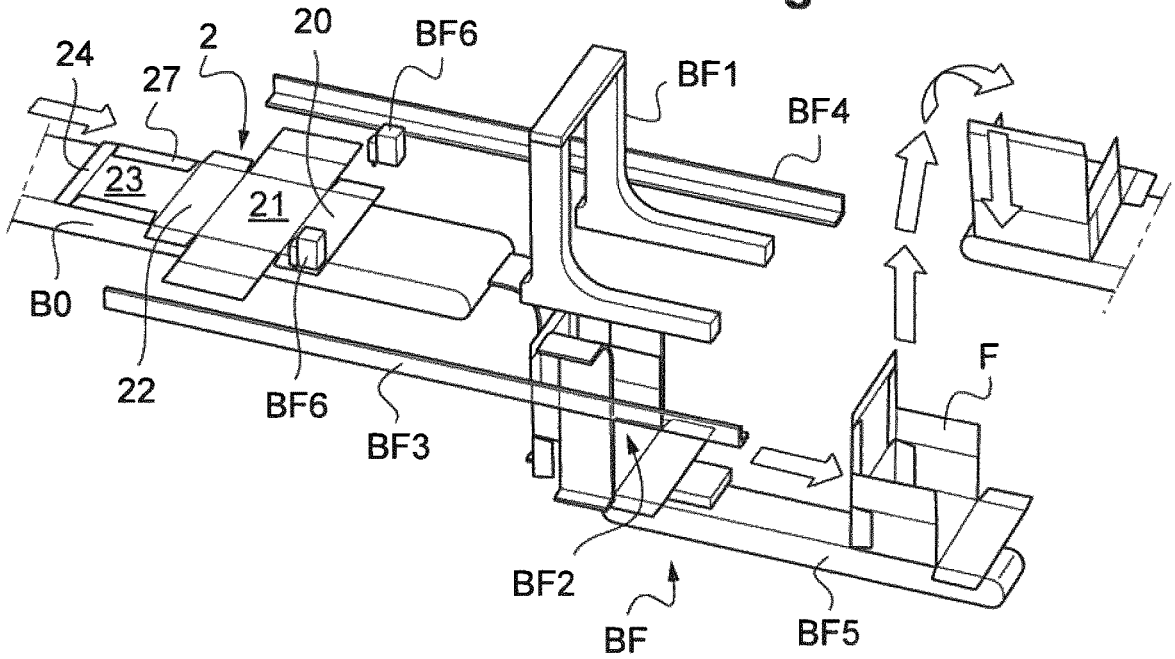
FIG. 33 is a perspective view of the device for box forming and transfer, illustrating its functioning (Unit B).

The forming station BF is schematically illustrated on FIG. 33, which also shows its different steps of functioning.

FIG. 33 shows the belt 2 transferred by the conveyor B0 in order to enter the forming station. During that transfer, the first flaps 25 and 26 of the first belt 2 and the third flap 24 are coated with glue by means of the hot-melt guns B6.

The forming station include a forming tool BF1 which can move along a vertical axis (perpendicular to the plane of the conveyor B0), a cavity BF2 here defined by three elongated bodies, two guiding means BF3 and BF4, extending on each side of the cavity BF2 and substantially parallel to the conveyor B0 and two folding and pressing means (not illustrated).

The forming station also includes an ejection and transfer device which comprises an ejection tool BF5.

When the central panel of the belt 2 is positioned under the forming tool BF1, the latter is moved downwards and the belt is formed inside the cavity BF2.

The folding and pressing means are then operated in order to fold the first flaps 26 of the belt 2 and to glue them on the outer face of the secondary panels 28.

The forming tool BF1 is then moved upwards to be again in the position illustrated in FIG. 33.

Finally, the partially erected box F is ejected from the cavity BF2 by means of the ejection tool BF5 using vacuum and suction pads.

The box shown in FIG. 7 is then transferred to Unit C, where the box will be filled with the product prepared in Unit D and then closed in Unit E.

Figure 34:
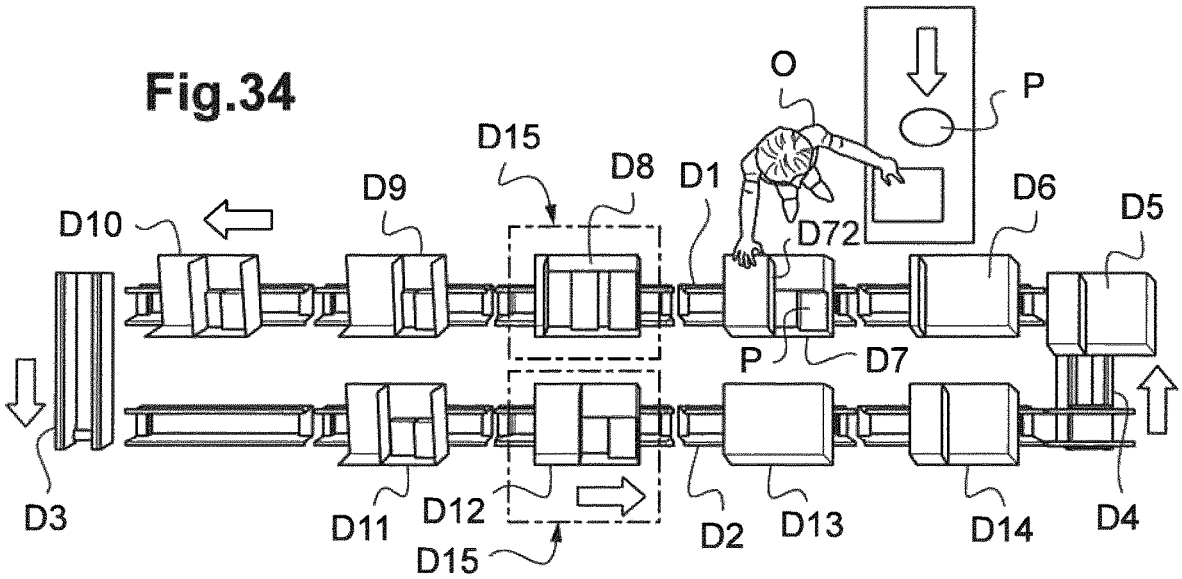
FIG. 34 is a top view of unit D (Order preparation Unit) showing different configurations of a crate for preparing products.

Unit D will now be described with reference to FIG. 34.

Unit D comprises two parallel conveyors D1 and D2 which are linked by lateral conveyors D3 and D4, so that the crates D5 to D14 may move along the loop formed by these four conveyors.

All the crates have the same structure which will be described with reference to FIGS. 35A to 35C, referring for instance to the empty crate D6.

This crate comprises a bottom D60 with two lateral sides D61 and D62 on two opposing sides.

The lateral side D61 is fixed while the position of the lateral side D62 can be adjusted.

The crate D6 also comprises a back side D63 which can move between a closed position as shown in FIG. 35A and an open position as illustrated on FIG. 35B (retractable back side).

FIG. 35C shows the movable lateral side D62 in a position where it has been moved towards the fixed lateral side D61.

As previously explained, the product P corresponding to the customer's order are supplied to an operator O who puts the product P in a crate D7.

The operator assembles the products in the crate so that they occupy a space smallest as possible.

In other words, each product is in tight contact with at least another product.

Then the operator or an automatic device moves the movable lateral side B72 of the crate to define the space occupied by the product P in the crate D7.

This movement at this stage is suitable if the product(s) to be packed are rigid or cannot be easily deformed. In case the product(s) can be deformed under pressure, the movable lateral side B72 is moved only after the size of the RPS box is determined as explained later.

The operator O or an automatic device labels the crate D7 with a barcode or an RFID tag.

The previously filled and labelled crate D8 is in a measurement area D15 where the size of the RSP box is determined.

As previously explained, the measurement area comprises measurement means for determining the largest length, width and height of the product(s) assembled in the crate which correspond the length H, the width W and the height H of the box designed to define an inner space close to the size of the product(s) which are intended to be housed in it.

As previously explained, on the basis of this measurement, a blank is picked up from one of the stacks A12 to A32, for instance from stack A22 and a box is manufactured according to the process and the machine previously described.

The crates D9 to D12 move along the loop defined by the four conveyors D1 to D4 and the crate D12 is in the box filling area D16.

In a preferred embodiment, the crates are slightly inclined backwards (by a tilt angle ranging from 5° to 10°) in order to keep the products in position in the corresponding crate during its transfer along the loop of conveyors.

Opposite the filling area D15 of Unit D, the partially erected box F, prepared to house the products present in crate D12 is positioned in Unit C.

A final control can be made at this filling position to check whether the barcodes of the crate D12 and of the box F match.

Figure 36A:
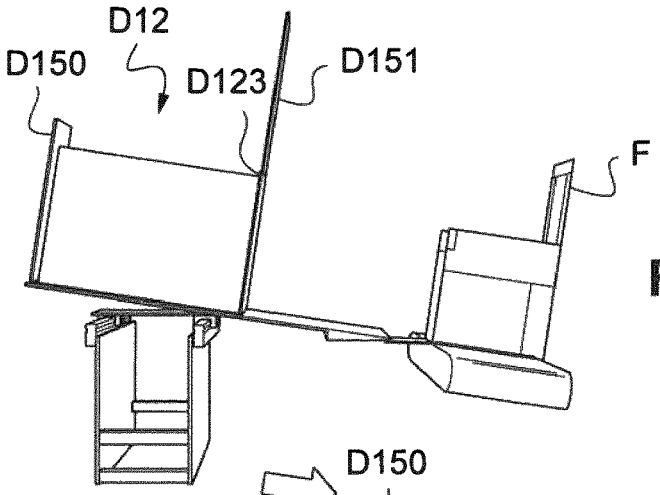
FIGS. 36A to 36D are lateral views of the crate illustrated in FIGS. 35A to 35C illustrating the filling step (Units C and D).

FIG. 36A shows the relative position of the crate D12 in Unit D and of the partially erected box F in Unit C.

FIG. 36A shows that the box F is also slightly inclined.

A back pusher 150 is positioned at the open side of crate D12 and a counter-pusher D151 is positioned along the back side D123 of the crate D112.

Figure 36B:
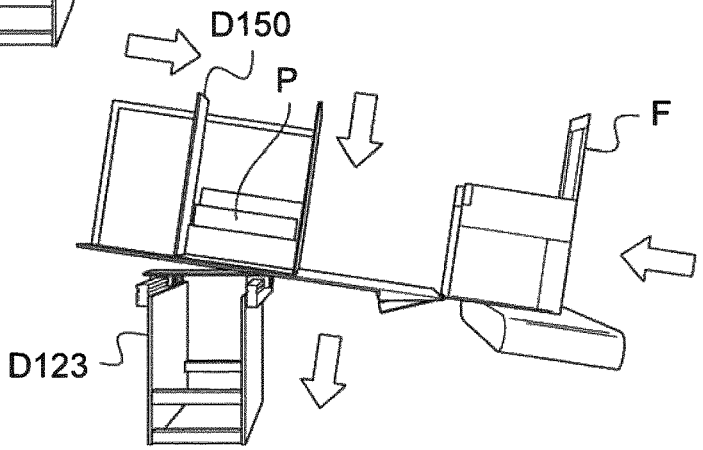

FIG. 36B shows a further step where the back side D123 of the crate is moved to its open position and the pusher D150 is activated.

It can be pointed out that a crate is a secure transportation means for the product(s) to be packed.

Figure 36C:
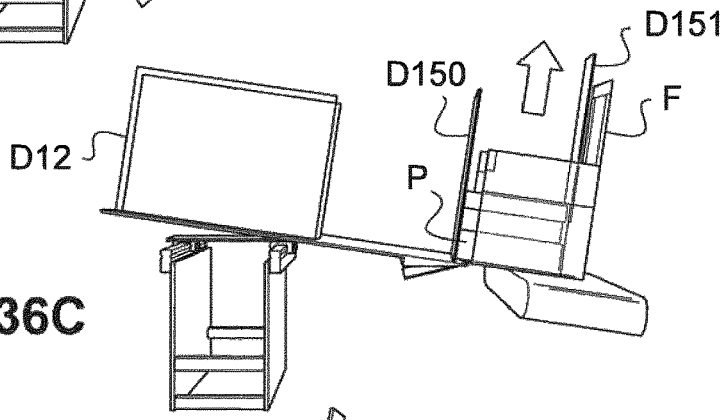
Figure 36D:
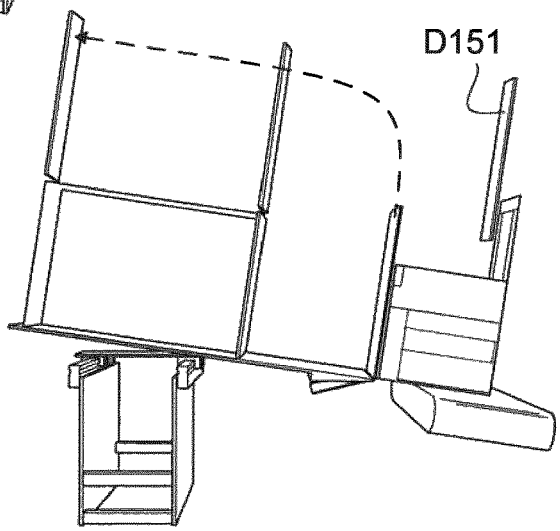

FIG. 36C shows the products P in the box F, the products being held between the pusher D150 and the counter-pusher D151.

The pusher D150 and the counter pusher D151 are then lifted up (FIG. 36D) and they are moved to their original position (as shown in FIG. 36A).

After its filling, the box is transferred on the conveyor B4 of Unit E to a position where the box is closed as previously described in reference to FIGS. 9 and 10.

Moreover, the examples of the methods according to the invention previously described show that the invention enables to form a box which is closely

The invention claimed is:

1. A method of manufacturing a belt from a blank and provided in a stack of blanks, the blank comprising a one piece blank of a corrugated cardboard sheet material designed for forming a belt intended to form a box having a length L, a width W, and a height H, wherein the blank includes a main rectangular body extending along a longitudinal direction and two protruding rectangular parts extending in a transverse direction and symmetrically with regard to the main body, so as to define two perpendicular branches, a first branch being defined by the main body and a second branch defined by the protruding parts, the main body having a width larger than the length L and a length larger than at least twice the width W plus the height H and each of the protruding parts having a length larger than the height H or the width W and a width larger than the width W or the height H;

wherein, after removal of the blank from the stack, the blank is then cut to reduce the length and/or the width of the branches of the blank so that the branches are adapted to the dimensions of the belt and wherein two first parallel fold lines are created between the main body and the protruding parts to define two secondary panels which are intended to form the third or the fourth lateral wall of the box and determine the height H and the width W of the box and at least three second parallel fold lines are created in the main body to define four main rectangular panels which are intended to form the top, the bottom and the first and second lateral walls of the box and determine the length L and the width W or the height H of the box, first parallel fold lines being perpendicular to the second fold lines and a secondary panel being provided on each of two opposing sides of one of the main panels.

2. The method according to claim 1, wherein the blank is cross-shaped and each of the protruding parts has a length larger than the height H and a width larger than the width W, and is positioned relative to the main body so that it is spaced from each end of the main body by a distance larger than the height H or the width W plus the height H.

3. The method according to claim 2, wherein one of the main panels of the belt intended to form the bottom of the box being provided on each of two opposing sides with a secondary panel intended to form the third or the fourth lateral wall of the box and each of the secondary panels being connected to a flap, each of the protruding part has a length larger than the height H and the width w" of said flap.

4. The method according to claim 1, wherein the blank has a T-shape and each of the protruding parts has a length larger than the width W and a width larger than the height H.

5. The method according to claim 1, wherein the belt having four rectangular main panels intended to form the top, the bottom and the first and second lateral walls of the box and at least one pair of first flaps being connected on opposing sides of a main panel, the width of the main body is equal to or larger than the length L plus twice the width w' of a first flap of the box.

6. The method according to claim 1, wherein the belt having four rectangular main panels intended to form the top, the bottom and the first and second lateral walls of the box and the main panel of the belt intended to form the top of the box being connected to a third flap which is intended to be glued on the second lateral wall to close the box, the length of the main body is equal to or larger than twice the width W and the height H plus the width w of the third flap of the box.

7. The method according to claim 1, wherein the first parallel fold lines are created in the main body to define at least one pair of first flaps which are connected on opposing sides of a main panel.

8. The method according to claim 1, wherein four second parallel fold lines are created in the main body to define a third flap connected to the main panel intended to form the top of the box.

9. The method according to claim 1, wherein the secondary panels being provided on each side of the main panel intended to form the bottom of the box, a third fold line, parallel to the first fold lines, is created in each protruding part to define a flap.

* * * * *